United States Patent [19]

Pilley, deceased et al.

[11] Patent Number: 4,809,640

[45] Date of Patent: Mar. 7, 1989

[54] COATING OF ARTICLES

[75] Inventors: Terence W. J. Pilley, deceased, late of Nazeing, by Mervyn H. Pilley, executor; Fred B. Pilling, Bolton; Graham Ryall, Carterton, all of United Kingdom

[73] Assignee: Metal Box Public Limited Company, Reading, United Kingdom

[21] Appl. No.: 94,735

[22] PCT Filed: Nov. 3, 1986

[86] PCT No.: PCT/GB86/00676

§ 371 Date: Jul. 15, 1987

§ 102(e) Date: Jul. 15, 1987

[87] PCT Pub. No.: WO87/02600

PCT Pub. Date: May 7, 1987

[30] Foreign Application Priority Data

Nov. 2, 1985 [GB] United Kingdom ..... 8527039
Jun. 14, 1986 [GB] United Kingdom ..... 8614527
Oct. 6, 1986 [GB] United Kingdom ..... 8623911

[51] Int. Cl.[4] ..... B05D 1/02; B05B 1/04

[52] U.S. Cl. ..... 118/257; 118/304; 118/320; 118/322; 118/DIG. 4; 427/420

[58] Field of Search ..... 118/DIG. 4, 257, 304, 118/320, 322; 427/420

[56] References Cited

U.S. PATENT DOCUMENTS

| | | | |
|---|---|---|---|
| 2,821,158 | 1/1958 | Brown et al. | 118/304 |
| 3,422,793 | 1/1969 | Lachmann | 118/301 |
| 3,951,101 | 4/1976 | Karakawa et al. | 118/301 |
| 4,099,486 | 7/1978 | Bialorucki et al. | 118/322 X |
| 4,259,377 | 3/1981 | Baize | 118/DIG. 4 X |

FOREIGN PATENT DOCUMENTS

| | | | |
|---|---|---|---|
| 2742206 | 3/1979 | Fed. Rep. of Germany | 427/420 |
| 310212A1 | 8/1982 | Fed. Rep. of Germany . | |
| 2248882 | 5/1975 | France . | |
| 1211006 | 11/1970 | United Kingdom . | |

*Primary Examiner*—Shrive Beck
*Attorney, Agent, or Firm*—Christie, Parker & Hale

[57] ABSTRACT

Plastic containers are given a coating of barrier or other coating material by being passed in close proximity to the lower edge of a plate curved downwardly. Liquid coating material is delivered to the back of the plate, to spread over it and fall as a curtain through which the article is passed, the article being rotated to present the whole of its recipient surface to the curtain. The articles may be tilted as they pass through the curtain.

48 Claims, 16 Drawing Sheets

FIG. 13
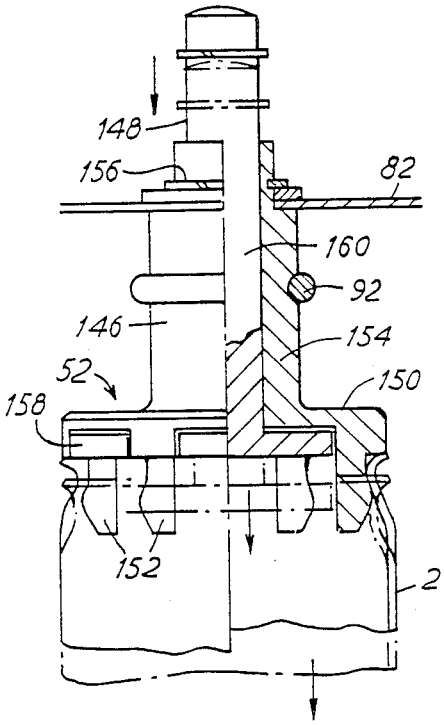
FIG. 15
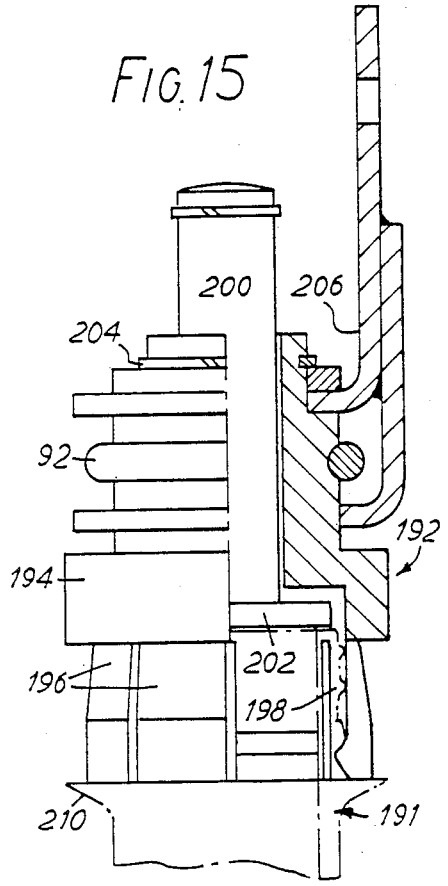
FIG. 14
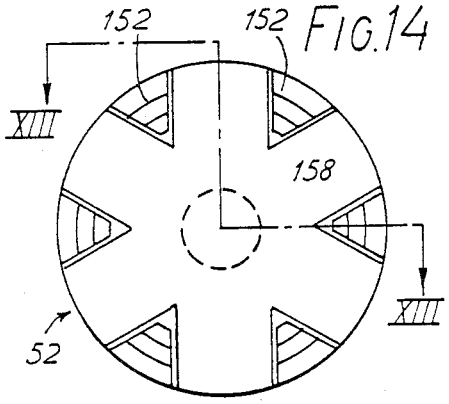
FIG. 16
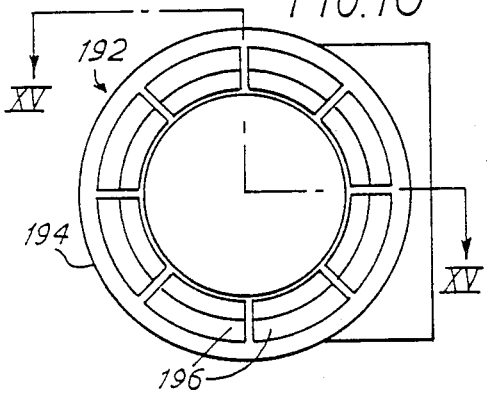
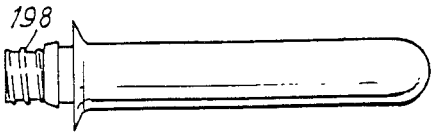
FIG. 17

COATING OF ARTICLES

This invention relates to methods and apparatus for the coating of articles such as, by way of non-limiting example, hollow, rigid or semi-rigid containers, by application of a liquid coating material to the articles, the coating material being subsequently dried or allowed to dry. In respect of the apparatus, the invention further relates to holders for carrying the articles through the apparatus.

The invention is typically but without limitation, concerned with the coating of packaging containers made of polymers such as polyethylene terephthalate (PET), by application of a coating material to enhance the barrier properties of the containers. By "barrier properties" we mean partly the ability of the container to resist ingress, through its walls, of air or other gases, microorganisms or spores of micro-organisms, the object generally being to protect a food or other product subsequently packed in the container from spoilage by oxidation or microbial action for a period sufficiently long to give the product a desired shelf-life. The term "barrier properties" equally means the ability of the container to contain products pressurised above the ambient pressure, such as carbonated beverages, or foods or drinks packed under aseptic (sterile) conditions so that the internal pressure will not be significantly reduced, or (in the latter case) the sterility of the contents will not be contaminated from the atmosphere outside the container.

Coatings applied by the method or by the apparatus of this invention may have the further or alternative purpose of decoration, for example by providing a coloured opaque or transparent surface.

According to the invention in a first aspect, a method of applying a coating over a non-horizontal recipient surface of an article, comprises the steps of:

directing a supply of liquid coating material against a back surface of a curtain plate so as to spread the liquid over the back surface to fall as curtain from a lower edge of the curtain plate;

effecting continuous relative movement as between the article and the curtain plate, with the article closely in front of the curtain plate, such that the recipient surface intersects the curtain;

allowing the material to run freely down the recipient surface and allowing excess material to drain freely from it; and causing the coating so applied to dry on the recipient surface.

Where the method is used for coating an external recipient surface which extends around the article, the step of effecting relative movement preferably comprises simultaneously causing the recipient surface to intersect the curtain and effecting relative rotation as between the curtain plate and the article, so as to present the recipient surface progressively to the curtain.

Where the method is used for coating an external recipient surface which extends axisymmetrically around an article defining a central axis, the step in which the recipient surface intersects the curtain is preferably carried out with the central axis inclined to the vertical.

The step of effecting relative movement as between the article and the curtain plate may be carried out with an upper portion of at least that part of the recipient surface facing the curtain plate located above the level of the lower edge of the curtain plate so that the upper portion does not intersect the curtain. The method then preferably includes the further step of applying a band of coating material over the upper portion of the recipient surface before or after applying a coating by means of the curtain.

Preferably the band is applied by the method the subject of our co-pending U.S. patent application Ser. No. 093,565, filed July 15, 1987 as a national stage applicaton of Application No. PCT/GB86/00598, filed Oct. 6, 1986, claiming priority of UK patent applications. Nos. 8524517 and 8614527. As applied to the method of the present invention, by way of this additional step, the step of coating the upper portion preferably comprises:

directing a stream of liquid coating material on to a moving donor surface of an elongate donor member while moving the latter continuously along a first path, so as to charge the donor surface with a predetermined quantity of the material; and effecting continuous relative movement as between the recipient surface and the donor surface so that the latter transfers coating material on to the upper portion of the former in said band.

The said donor member may be in the form of an endless belt, the method comprising maintaining, while the belt is in contact with the article, both the article in its rotation and the belt in motion in said first path.

Preferably, the liquid coating material, both for the curtain and for coating the upper portion of the recipient surface, is supplied from a common source.

Excess material is preferably allowed to drain from the article to descend freely through the atmosphere directly into an open pool from which it spills directly into a reservoir, the coating material being supplied to the curtain plate from the said reservoir.

According to the invention in a second aspect, apparatus for applyig a coating over a recipient surface of an article, comprises:

holding means for holding the article with the recipient surface in a non-horizontal attitude;

a forwardly and downwardly curved curtain plate having a generally horizontal, free lower edge;

nozzle means for directing a continuous supply of liquid coating material against the back surface of the curtain plate so as to spread the liquid over the back surface to fall as a curtain from its lower edge;

means for effectng continuous relative movement as between the article and the curtain plate such that, with the holding means and the article closely in front of the curtain plate, the recipient surface will intersect the curtain when the nozzle means is operating; and drying means for drying coating material applied to the article by its contact with the curtain.

Preferably the apparatus includes a tilting member associated with the forward path upstream of the curtain plate, to engage the recipient surface itself whereby to tilt the article and holding means into an inclined attitude with the central axis of the article inclined to the vertical, and a tilt guide member for co-operating with the holding means for maintaining the inclined attitude throughout the advance of the article past the curtain plate, the holding means having a guide follower means for cooperating with the guide member.

The tilt guide member and guide follower means are preferably so disposed as to come into cooperation with each other only if an article held by the holding means has been tilted by the tilting member, so that the holding means fails to assume the said inclined attitude unless holding a said article.

A modificiation may be included in the form of further guide means for engaging guide follower means on the holding means so as to deflect the latter away from the curtain plate, the further guide means being downstream of the tilting member with respect to the forward path and so disposed that it can only engage its associated guide follower means if the holding means has failed to be tilted by engagement of an article held thereby with the tilting member, the further guide means beiing arranged to keep the holding means so tilted away until it has passed the curtain plate.

When band coating as described above is to be used, the apparatus has a main coating station at which the curtain plate is located, an auxiliary coating station having band coating means for applying a band of coating material over an upper portion of the recipient surface not coated at the main coating station, and transfer means for moving holding means carrying the article between the two stations.

According to a preferred embodiment of the invention, there is provided apparatus for coating a succession of substantially identical articles, and having a main coating station at which the curtain plate and its nozzle are located; article-advancing means comprising an overhead conveyor arranged to be advanced at substantially constant speed, with a plurality of the holding means suspended at intervals from the conveyor, which extends through the main coating station and the drying means; and a supply system for liquid coating material, comprising the nozzle, a reservoir for said material, means for supplying the nozzle from the reservoir, and return means for collecting excess coating material from the main coating station and from articles coated thereat.

Where there is also an auxiliary coating station, the supply system of the apparatus preferably comprises the nozzles at the coating stations, a reservoir for said material, means for supplying the nozzles from the reservoir, and return means for collecting excess coating material from the coating stations and from articles coated thereat.

The return means preferably comprises a pan for containing an open pool of coating material, the pan extending directly under that portion of the conveyor from which excess coating material falls from articles carried thereby, the pan having a spillway to allow coating material to spill directly back into the reservoir.

According to the invention in a third aspect, a holder, for suspending a hollow article from an overhead conveyor, comprises a carrying head with integral resilient fingers depending therefrom, the fingers being so arranged that when resiliently deformed they define together an endless profile corresponding to the profile of a portion of an article to be gripped by the fingers, and a simple plunger member mounted freely in the carrying head and reciprocable downwardly to eject the article from the holder.

Methods and apparatus according to the inventon in its various aspects will now be described by way of example, with reference to the accompanying drawings of this Application, in which.

Figure 2:
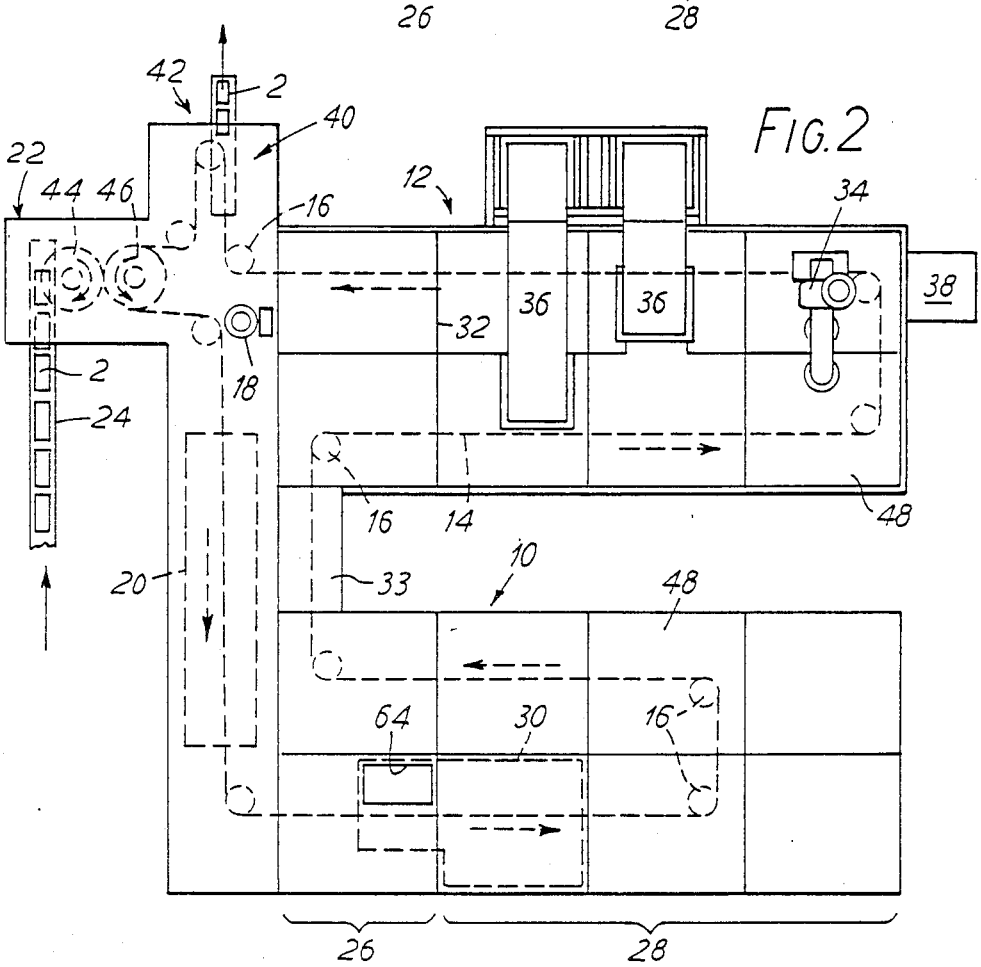
FIG. 2 is a much-simplified plan view of the machine seen in FIG. 1.
Figure 3:
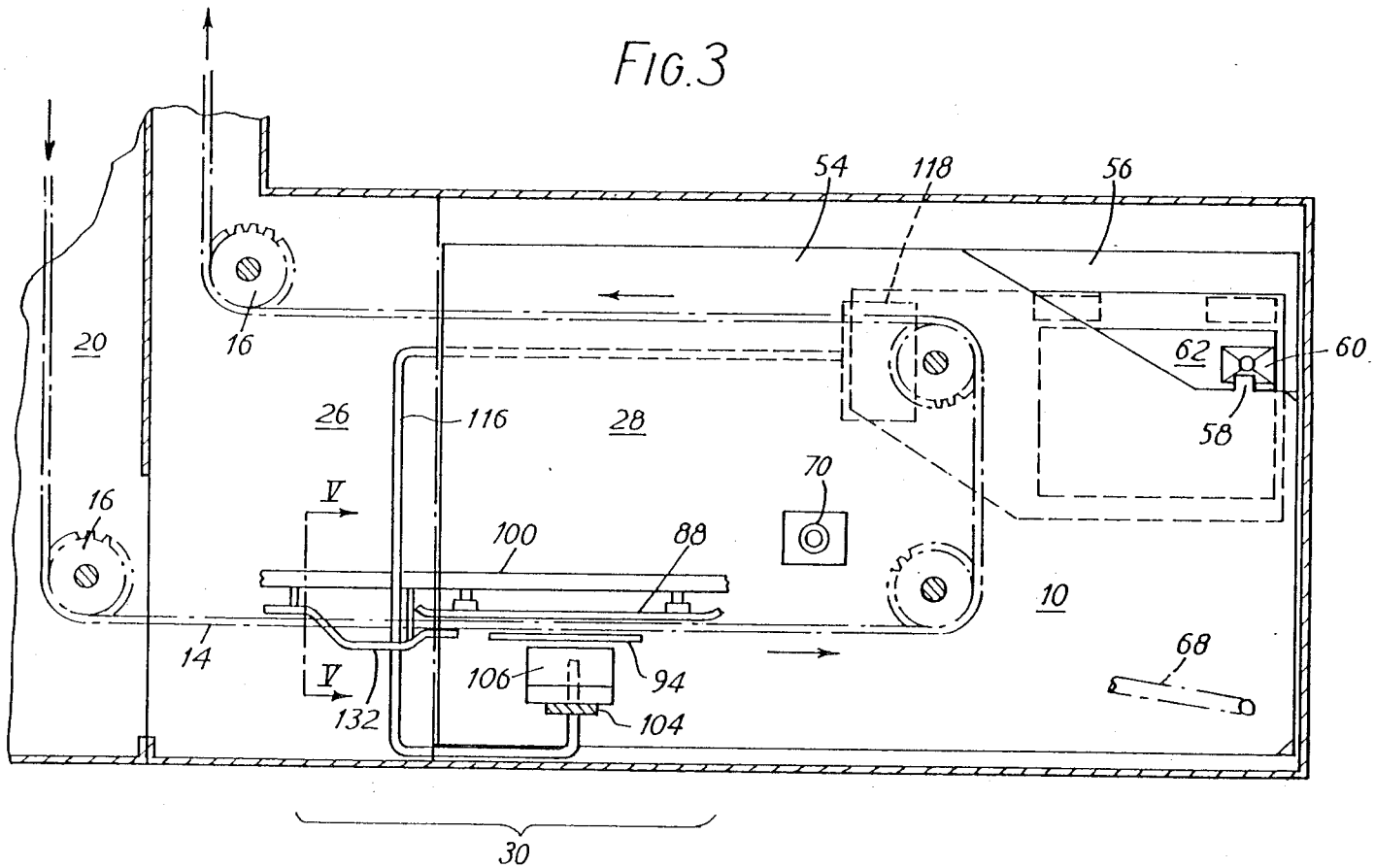
Figure 4:
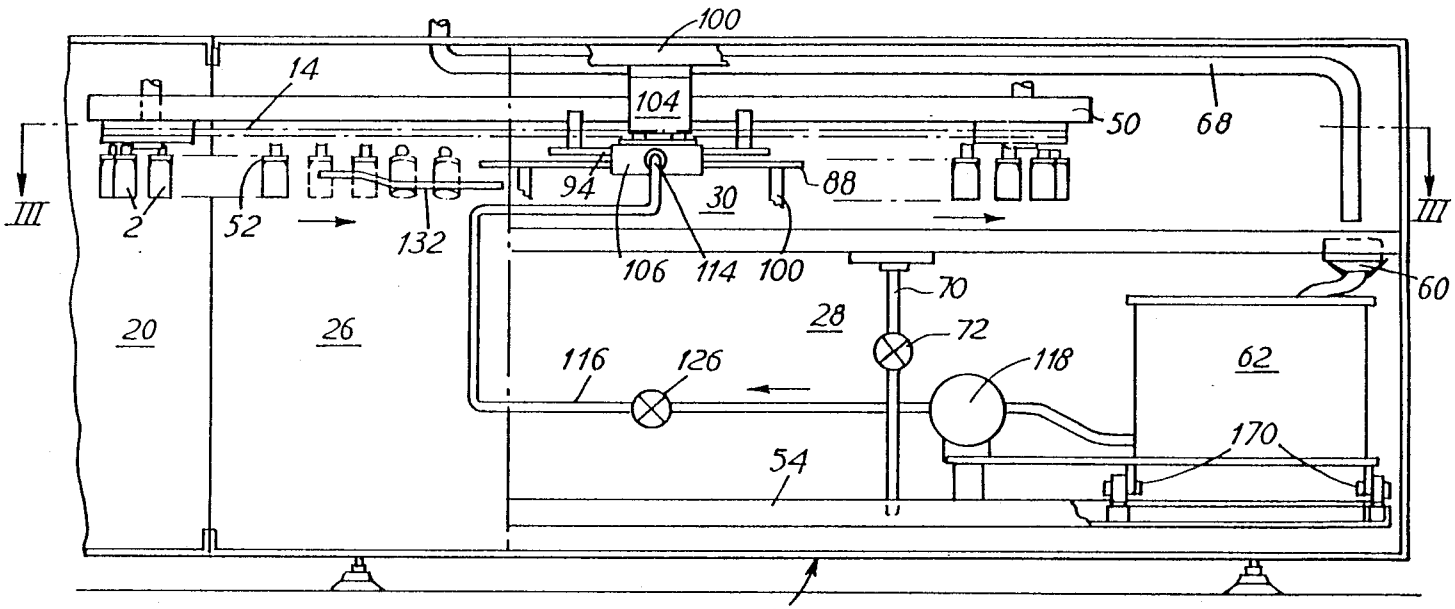
Figure 5:
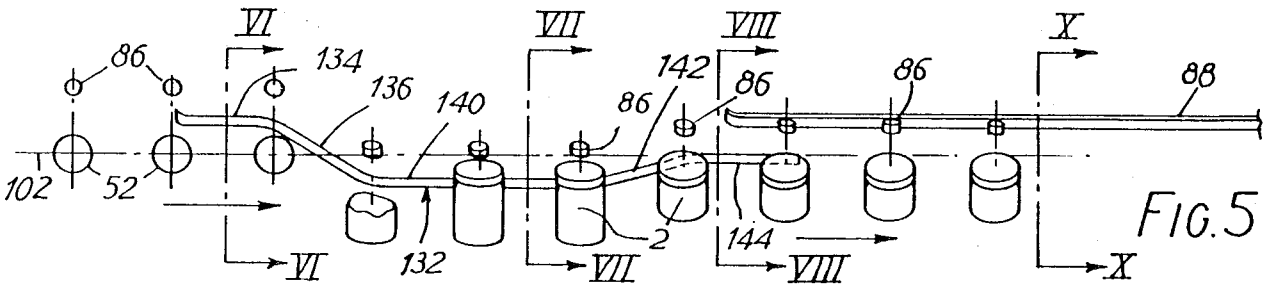
Figure 6:
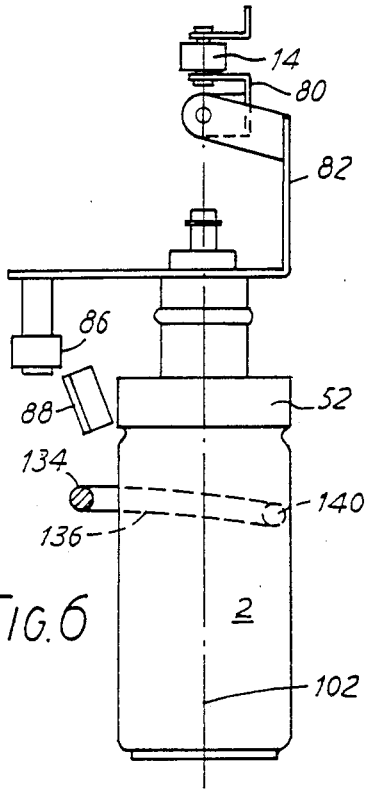
Figure 7:
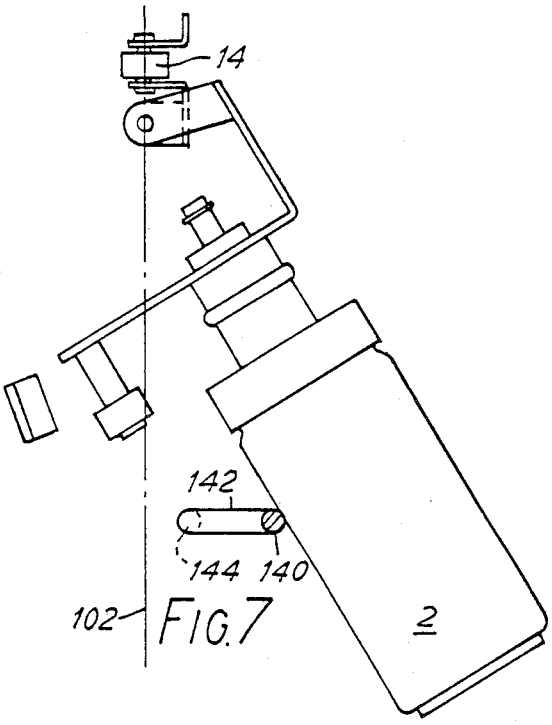
Figure 8:
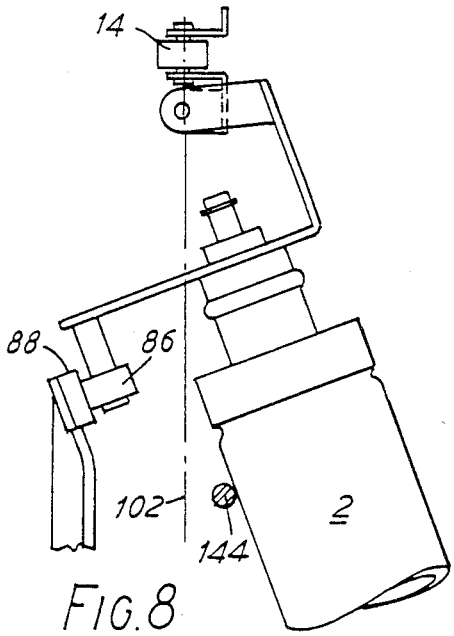
Figure 9:
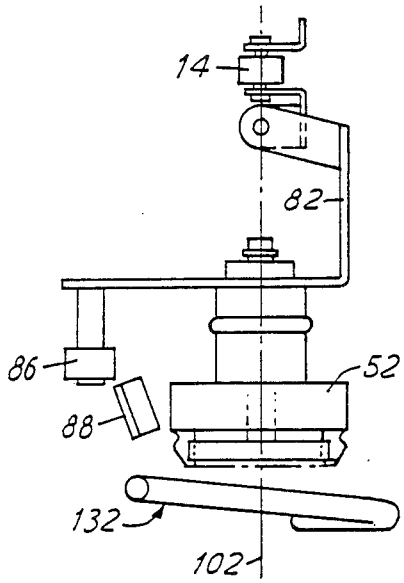
Figure 10:
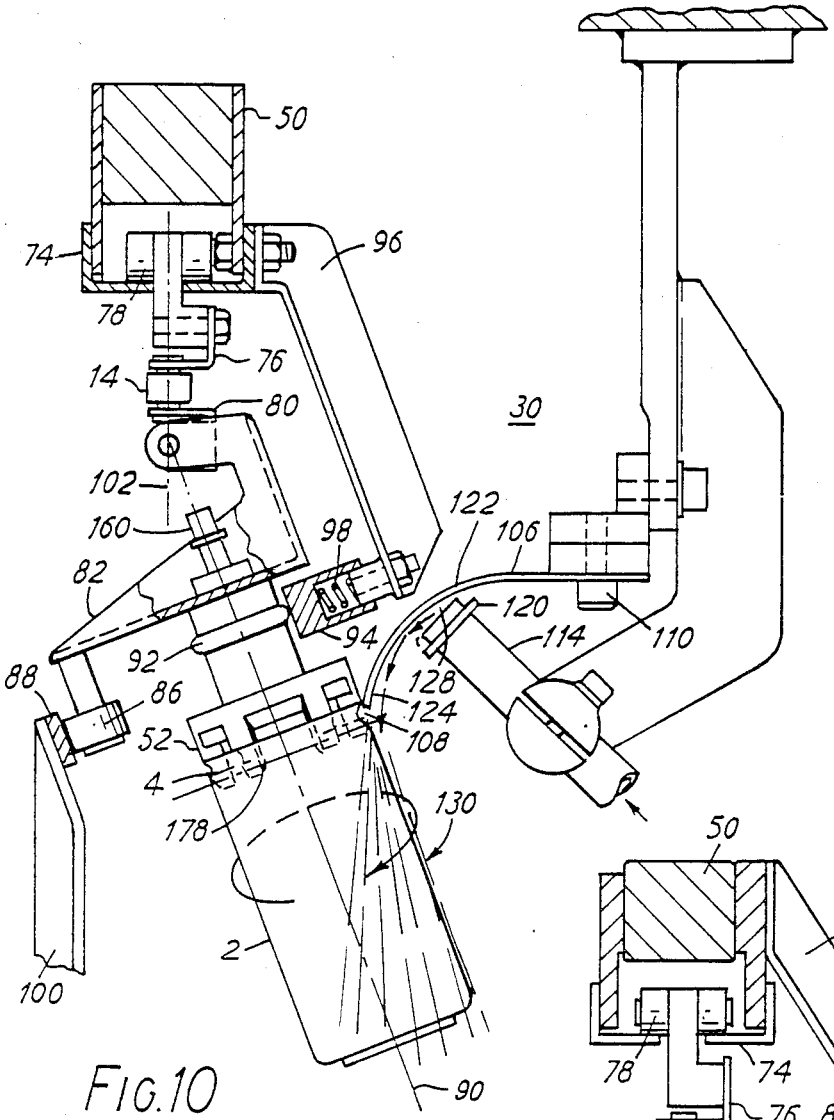
Figure 11:
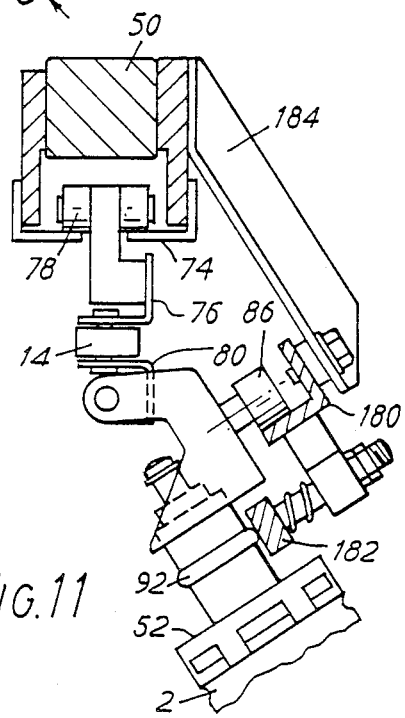
Figure 12:
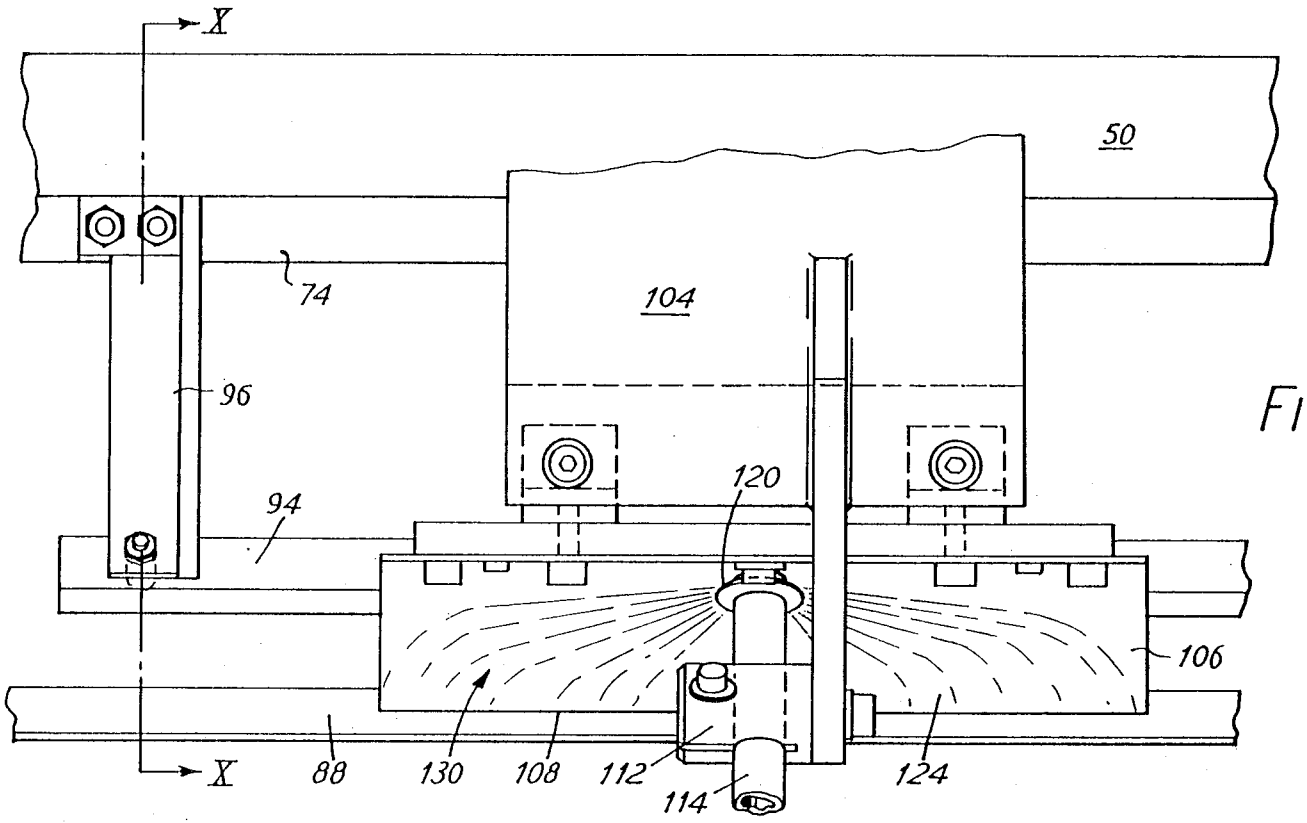
Figure 18:
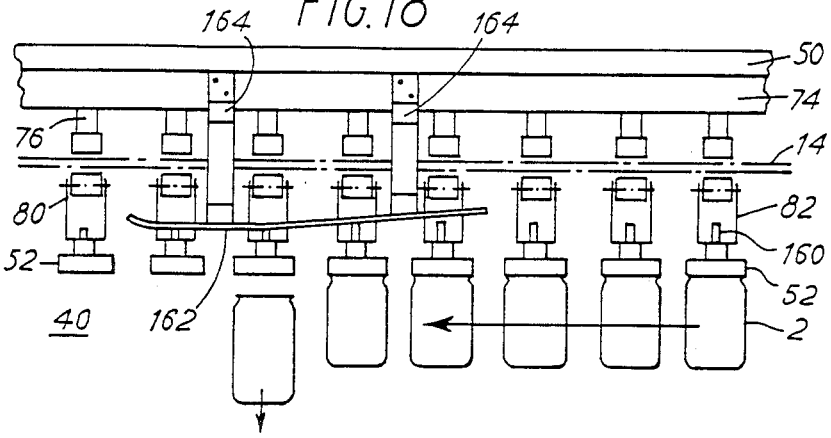
Figure 19:
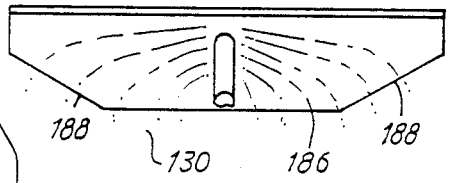
Figure 20:
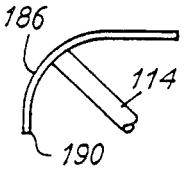
Figure 21:
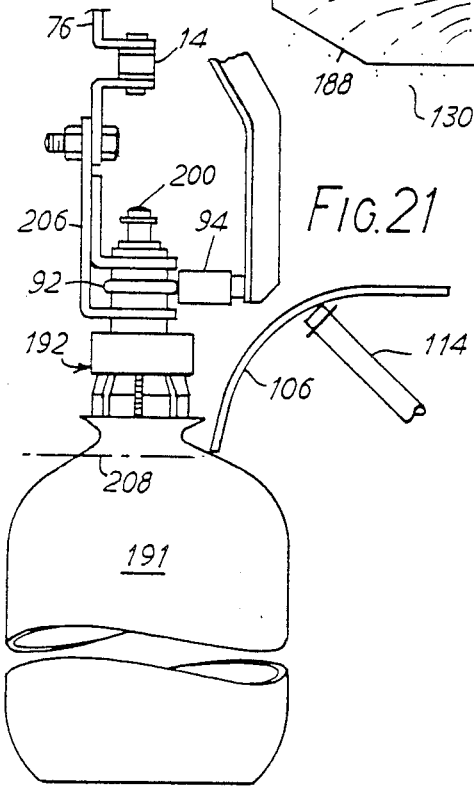
Figure 22:
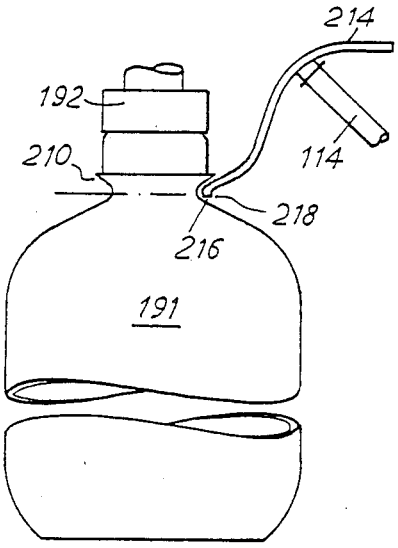
Figure 25:
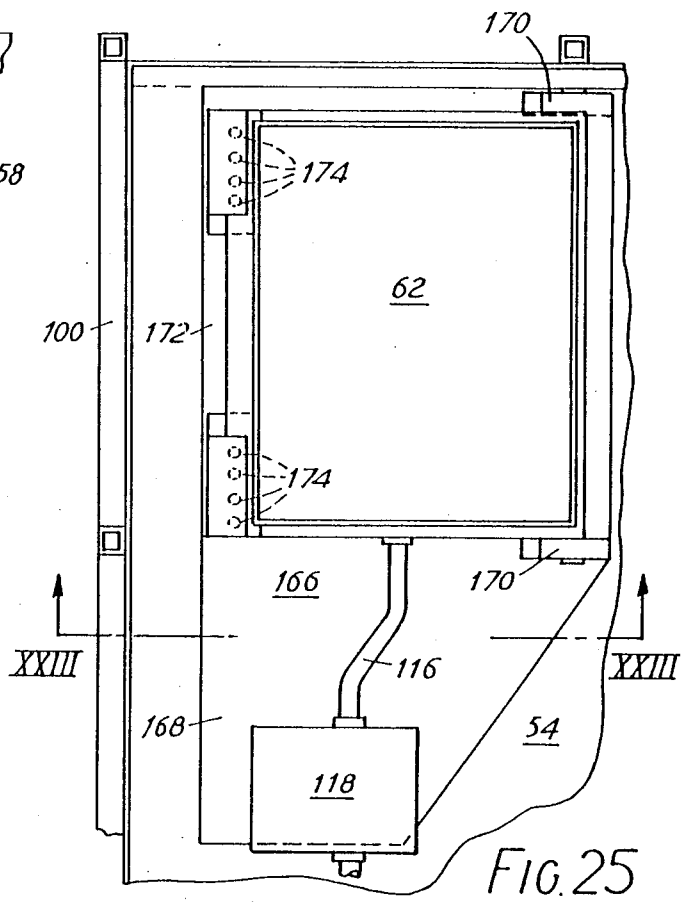
Figure 24:
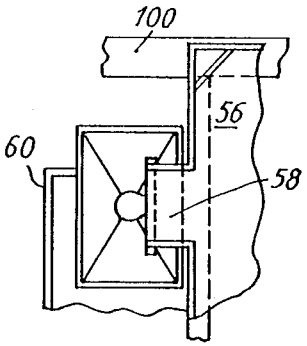
Figure 23:
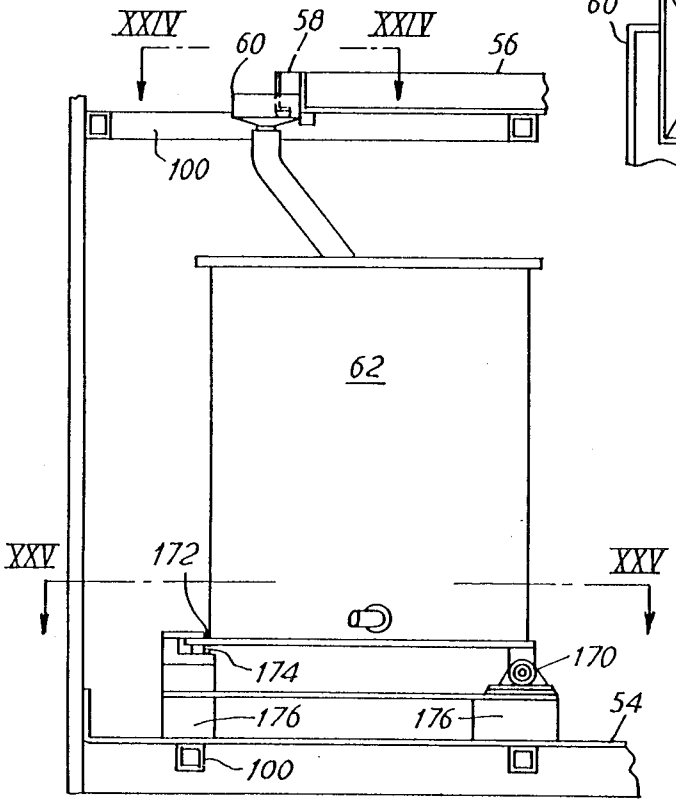
Figure 26:
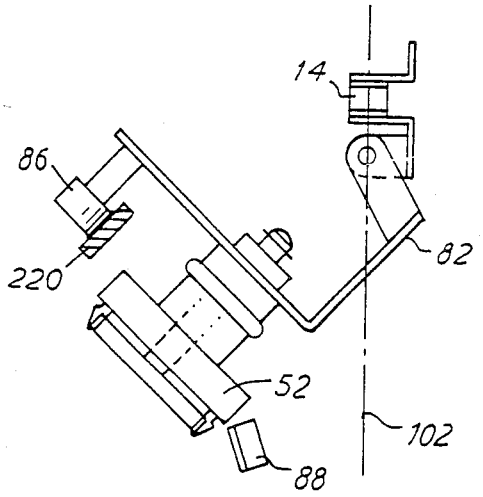
Figure 27:
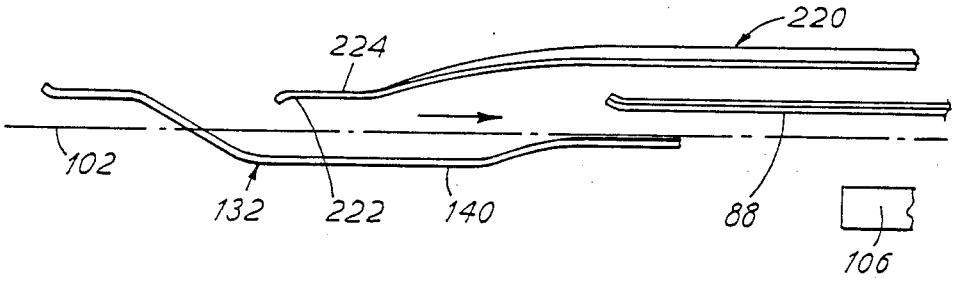
Figure 28:
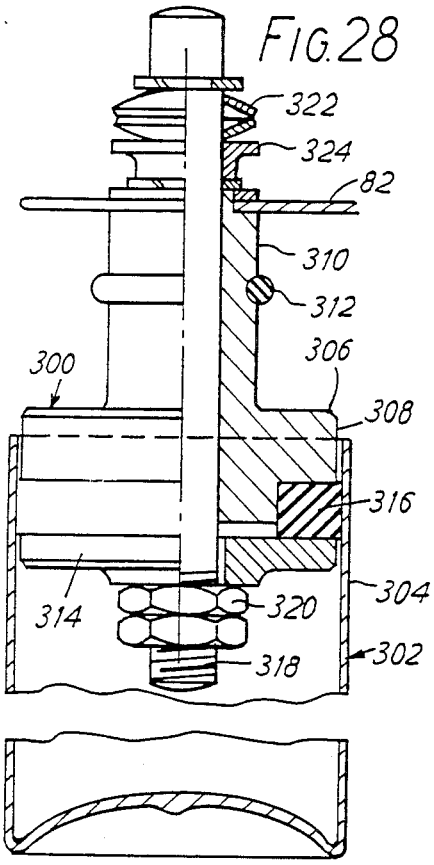
Figure 29:
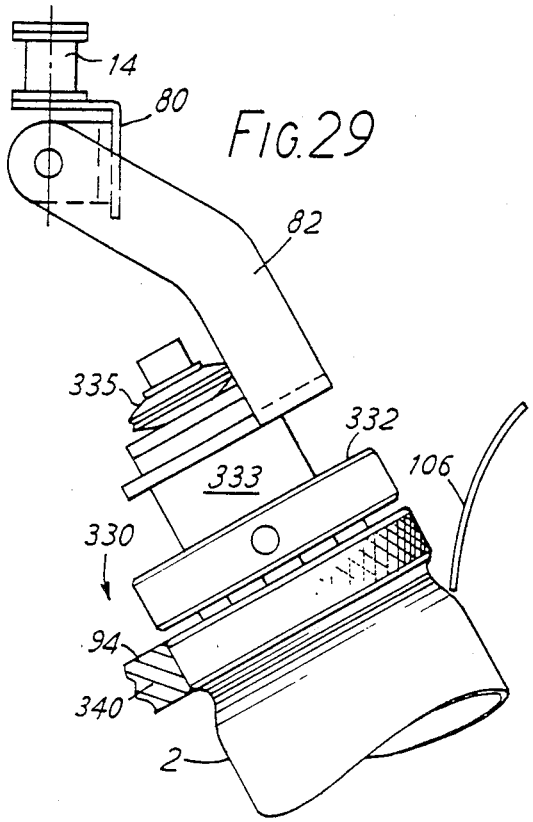
Figure 30:
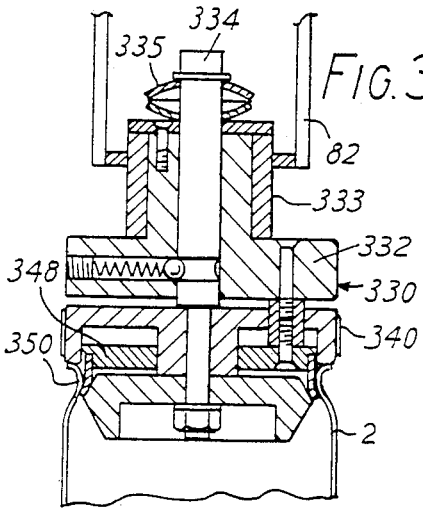
Figure 31:
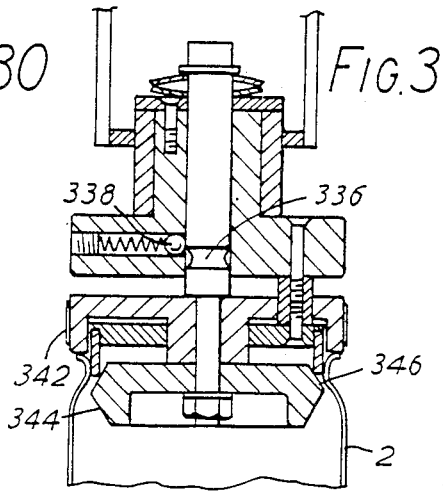
Figure 36:
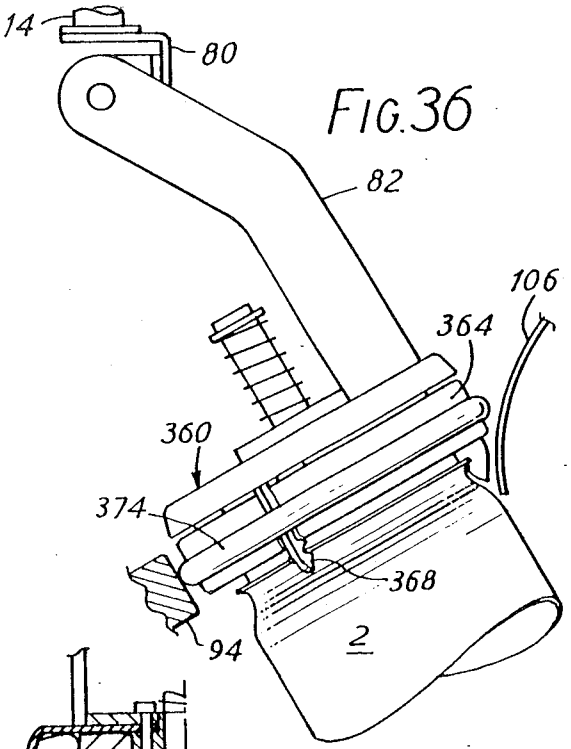
Figure 35:
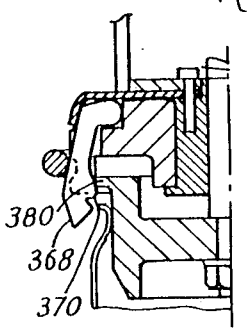
Figure 34:
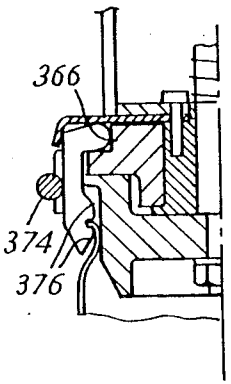
Figure 33:
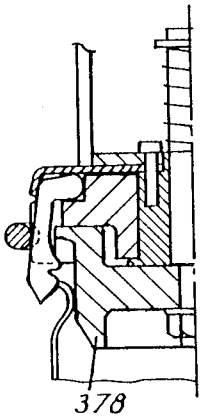
Figure 32:
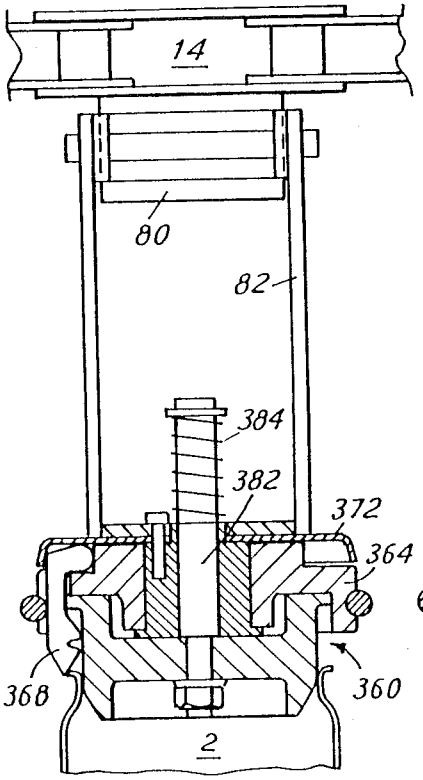
Figure 37:
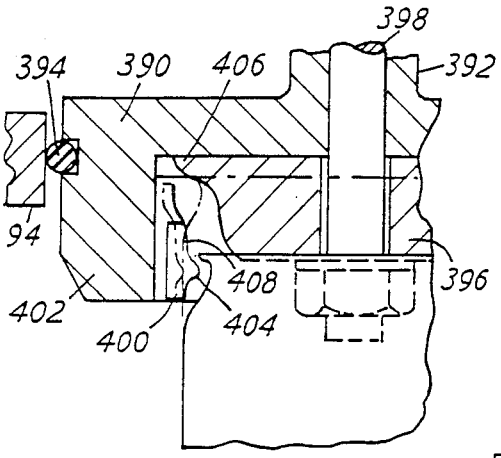
Figure 38:
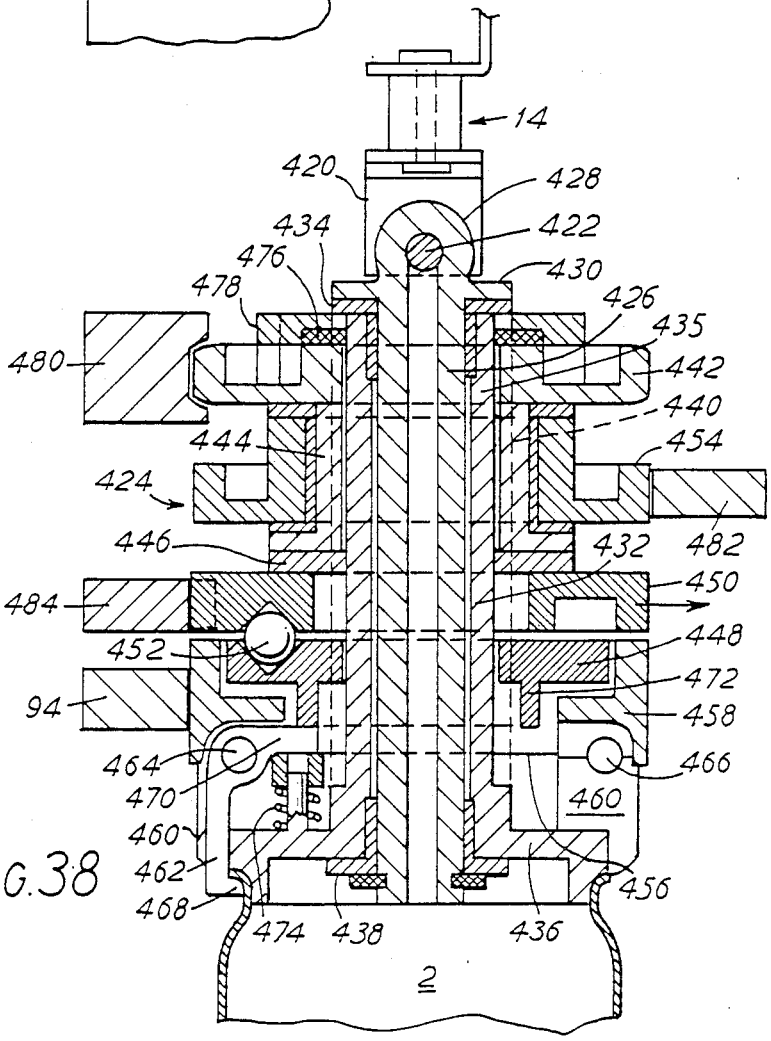
Figure 39:
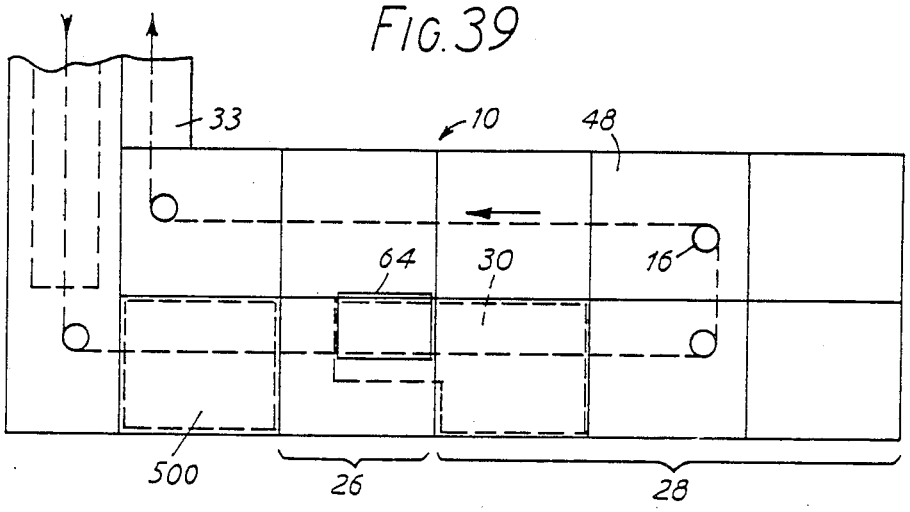
Figure 40:
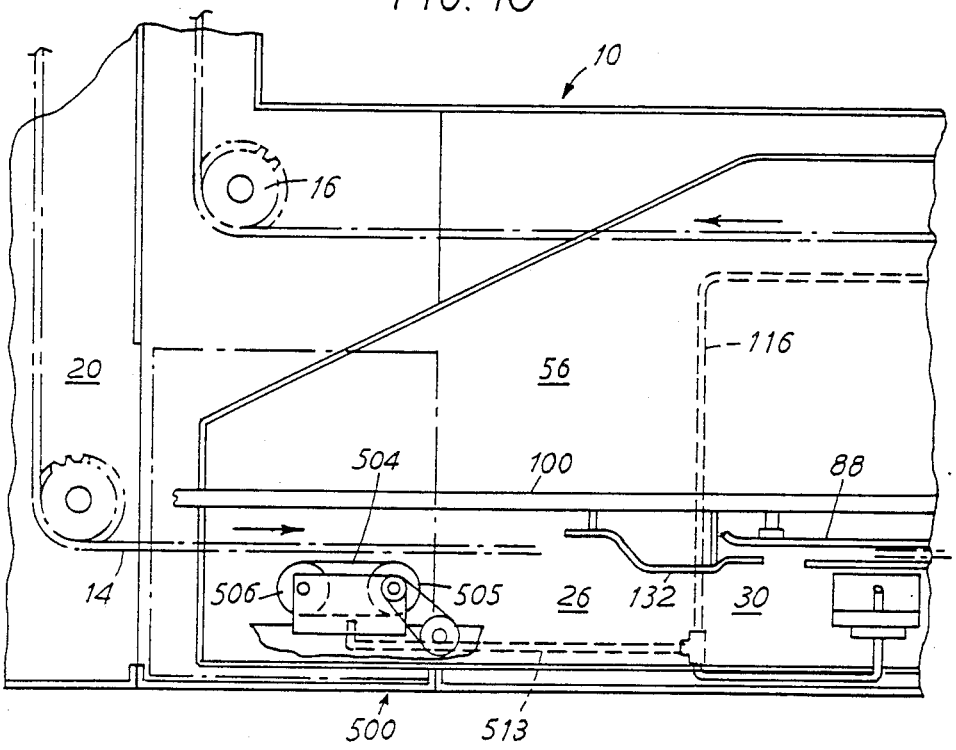
Figure 41:
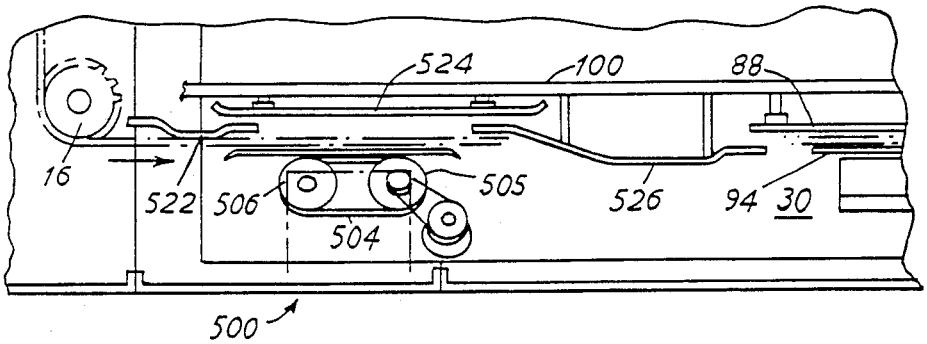
Figure 42:
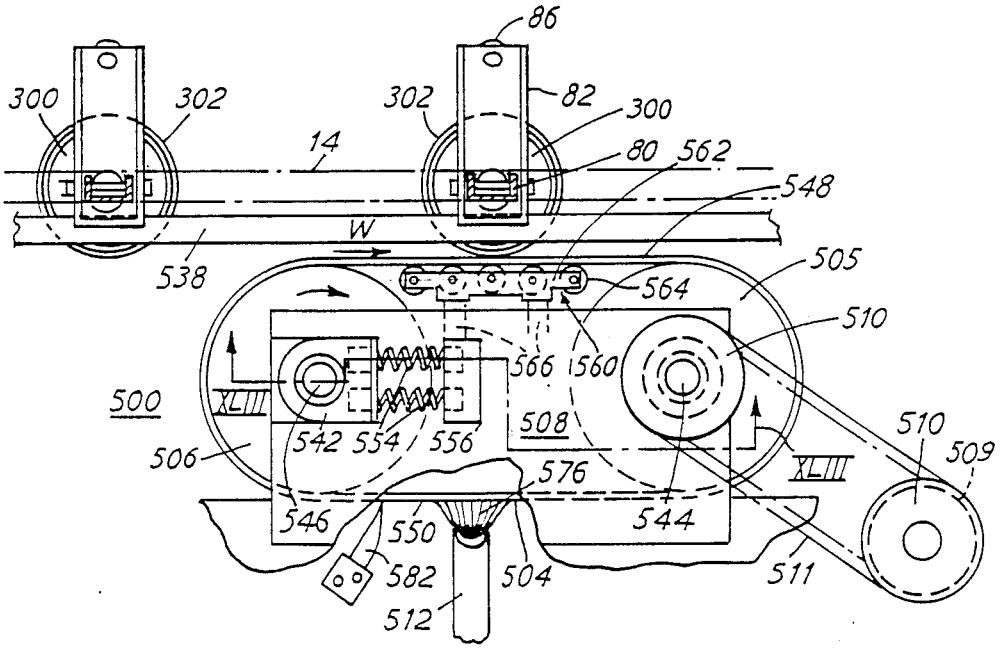
Figure 43:
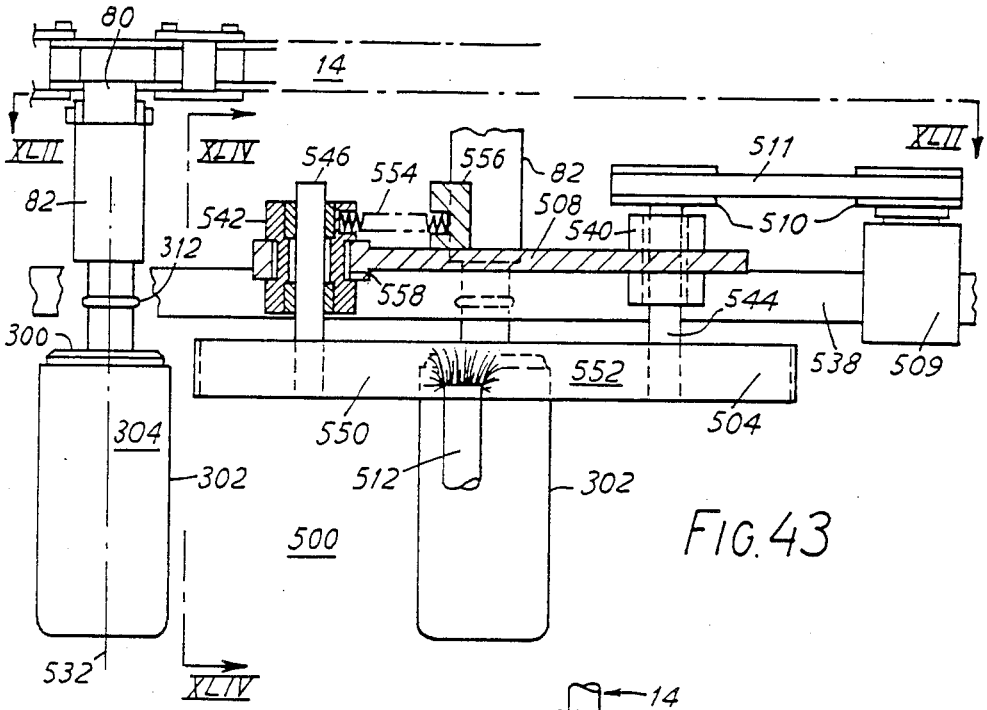
Figure 45:
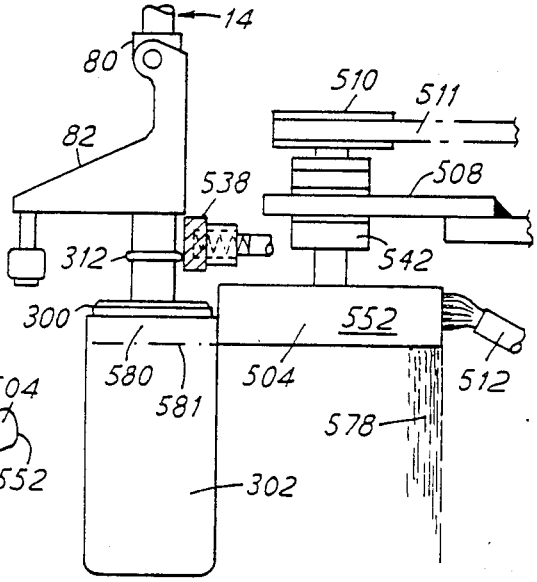
Figure 44:
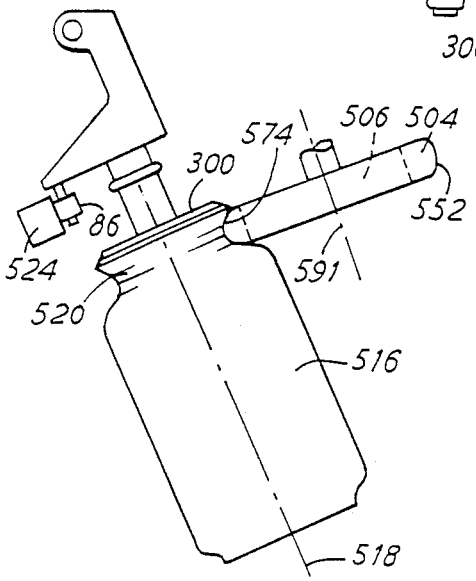

FIG. 3, again much simplified, is a sectional plan view taken on the line III—III in FIG. 4, showing the coating and draining unit of the same machine;

FIG. 4 is a front elevation of the coating and draining unit with the front panels (seen in FIG. 1) removed;

FIG. 5 is a diagrammatic plan, showing on a larger scale the arrangement and operation of tilting means shown in FIG. 3;

Figurse 6 to 9 are simplified views further showing the operation of the tilting means: FIGS. 6 to 8 being taken on the section planes VI—VI, VII—VII and VIII—VIII respectively in FIG. 5 and showing three successive stages in the positioning of a container ready for coating, while FIG. 9 shows an empty holder as viewed from the left-hand end of FIG. 5;

FIG. 10 is a sectional endwise elevation taken on the line X—X in FIGS. 5 and 12, and shows a container being coated at the coating station;

FIG. 11 is a scrap view similar to part of FIG. 10 but showing a modification to the means whereby the container is carried through the coating station;

FIG. 12 is an elevation as seen from the right-hand side of FIG. 10, but with the container and its holder omitted;

FIG. 13 is an elevation, shown partly in section on the line XIII—XIII in FIG. 14, of the holder seen in FIG. 10;

FIG. 14 is an inverted plan of the same holder;

FIG. 15 is an elevation, shown partly in section on the line XV—XV in FIG. 16, of a first alternative form of holder, designed for bottles;

FIG. 16 is an inverted plan of the holder shown in FIG. 15;

FIG. 17 shows a tubular necked article;

FIG. 18 is a somewhat diagrammatic side elevation illustrating how containers are stripped from their holders after being coated;

FIG. 19 is a rear view of a curtain plate in a form modified from that shown in FIGS. 10 and 12;

FIG. 20 is an end view of the plate as seen from the left-hand side of FIG. 19;

FIG. 21 is a simplified view corresponding with FIG. 10 but illustrating use of the holder of FIGS. 15 and 16, the coating of a bottle, and the coating of an untilted article;

FIG. 22 shows another modified form of curtain plate;

FIG. 23 is a simplified sectional elevation, taken on the line XXIII—XXIII in FIG. 25, and showing a bulk tank for metering liquid coating material;

FIG. 24 is a scrap plan view, on a larger scale, as seen in the direction indicated at XXIV—XXIV in FIG. 23;

FIG. 25 is a sectional plan view taken on the line XXV—XXV in FIG. 23;

FIG. 26 is a simplified view similar to FIG. 9, but showing a modification in which an empty holder is tilted away from the flow of coating material at the coating station;

FIG. 27 corresponds with FIG. 5 but shows the modified arrangement of control rails used with the process modificiation seen in FIG. 26;

FIG. 28 is a part-sectional elevation showing a second alternative form of holder, suitable for a hollow article not having a lip or shoulder behind which the holder can engage;

FIG. 29 is a scrap elevation showing a third alternative form of holder, for internally engaging a hollow article;

FIG. 30 is a sectional view showing the holder of FIG. 29 engaged with a hollow article;

FIG. 31 is a view similar to FIG. 30 but showing the same holder in its release position;

FIG. 32 is a sectional view showing a fourth alternative form of holder, for externally engaging a flanged article, with a hollow article fully disengaged;

FIGS. 33 to 35 are half sections showing the holder of FIG. 32, respectively about to engage with, fully engaged with, and releasing, the article;

FIG. 36 is a scrap elevation showing the holder of FIGS. 32 to 35 in operation;

FIG. 37 is a simplified sectional scrap view showing parts of a fifth alternative form of holder, again for externally engaging a flanged article;

FIG. 38 is a sectional elevation showing a sixth alternative form of holder for externally engaging a flanged article;

FIG. 39 is a modified version of the lower part of FIG. 2, showing a coating machine with an auxiliary coating station as well as the main coating station shown in FIGS. 2 to 5;

FIG. 40 is a simplified plan view of the auxiliary coating station, drawn in the same manner as FIG. 3;

FIG. 41 is a modified version of part of FIG. 40;

FIG. 42 is a simplified plan view of the auxiliary coating station of FIG. 40 drawn to a larger scale than FIG. 40;

FIG. 43 is a simplified elevation as seen from the bottom of FIG. 42, partly in section on the line XLIII—XLIII in FIG. 42;

FIG. 44 is a simplified sectional end elevation on the line XLIV—XLIV in FIG. 43; and FIG. 45 is a diagrammatic and elevation relating to the modified auxiliary coating station of FIG. 41 and showing also a further modification, namely a donor belt deformable in cross-section to conform with an irregular profile of the article being coated.

Figure 1:
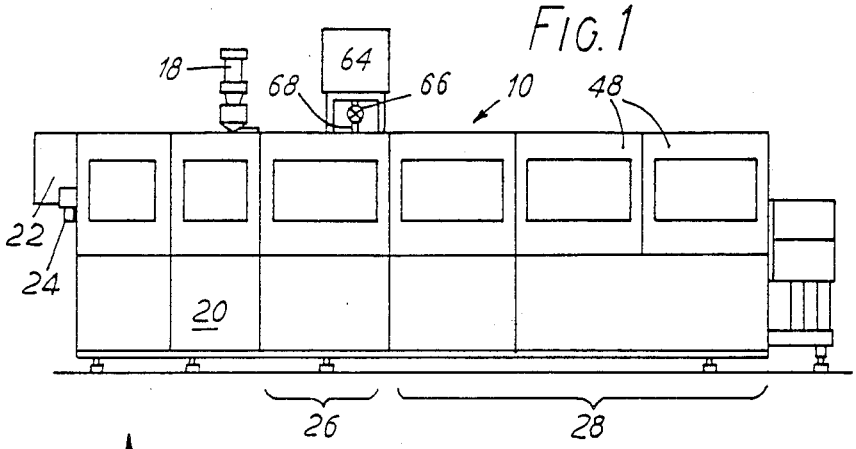
FIG. 1 is a much-simplified front elevation of a high-speed coating machine for applying a barrier coating to a large succession of articles in the form of packaging containers.

Referring to FIGS. 1 and 2, this coating machine is intended for the high-speed application of polyvinylidene chloride (PVdC) coatings to the containers 2 more clearly seen in, for example, FIGS. 10 and 18. Each of these containers is a cylindrical, monobloc vessel made of polyethylene terephthalate (PET) and having an open top end bounded by a neck 4 terminating in an outwardly-directed flange.

The machine comprises essentially a coating and draining unit 10 and a curing unit 12, extending parallel to each other and spaced apart as seen in FIG. 2. An endless carrier chain 14 extends through these and other units of the machine as indicated in broken lines, being driven by sprocket wheels 16. These (or a suitable number of them) are driven by a main drive motor 18 mounted on top of the machine.

The chain 16 enters the coating and draining unit 10 where indicated at 20 in FIG. 2, from a rinsing and drying unit 20 extending at right angles to the units 10 and 12. At the end of the housing containing the rinsing and drying unit remote from the coating and draining unit 10, is a loading unit 22 which receives containers 2 from a feed conveyor 24. The coating and draining unit basically comprises a "dry" section 26 followed by a "wet" section 28, flow of liquid coating material within the unit 10 being confined to the "wet" section 28. The carrier chain 14 extends through the front part of the "dry" section 26 and into the "wet" section, where it passes through a coating station 30 before crossing the unit 10 to pass in the reverse direction through the rear part of the unit. There is thus a considerable length of chain between the exit end of the coating station 30 and the point at which the chain leaves the "wet" section. The part of the unit 10 traversed by the chain between these points is the draining section of the coating and draining unit.

Shortly after leaving the "wet" section, the chain passes through a primary base wiping unit 33, whence it enters the curing unit 12. This consists of a hot-air type oven designed to cure the coating on the containers at a closely-controlled temperature. Air is supplied by a fan unit indicated at 34, and is extracted by ducts 36. The chain 14 makes a double pass through the curing unit 12, which is provided with a secondary base wiping unit 38 at the inlet end of the second or rearward part of the unit.

On leaving the curing unit, the chain passes through an unloading station 40 at which the containers are released to an exit conveyor 42. From the unloading station, the chain passes back into the loading unit 22. The latter is of generally known construction, having a helical feed-screw device (not shown) which feeds each container 2 in turn from the feed conveyor 24 to a first transfer turret 44, from which the containers are transferred via a second transfer turret 46 onto respective holders (not shown in FIGS. 1 and 2). The holders are suspended from the carrier chain 14 in a manner to be described below.

Thus the containers are loaded in succession onto the carrying means, the chain 14 of which is in continuous movement at constant speed; and the containers are then rinsed and dried in the unit 20, after which the liquid coating material is applied as they pass through the coating station 30. Excess material drains from the containers in the remainder of the "wet" section 28 of the coating and draining unit 10, though there may be some remaining accumulation of material on the base of each container. This is removed by the primary base wiping unit 33, following which the coating is cured in the oven 12, any final excess of coating material on the base of the container being removed by the unit 38.

The various units of the machine are constructed in the form of simple rectangular modules having a frame, not shown except in certain Figures where parts of the frame are relevant to understanding of the invention, and clad with removable panels 48, not shown except in FIG. 1 and 2.

FIG. 3 and 4 show the interior of the coating and draining unit 10 in greater detail. The carrier chain 14 is suspended from a fixed endless runway (which extends the whole length of the chain as seen in FIG. 2), the runway 74 being fixed to a beam 50 secured to the main frame of the machine. FIG. 4 shows some of the containers 2, carried by holders 52 which are suspended from the chain 14.

The "wet section" 28 of the coating and draining unit has a lower drain tray 54, of structural material such as polypropylene, extending the full length of the wet section. Above the lower tray 54, but below the containers 2 being carried through the unit, there is a main drain tray or "lake" 56, of the same material as the lower tray 54 and also extending the full length of the wet section. The coating station 30 lies wholly over the lake 56, into which liquid coating material not retained as coating on the containers falls with a minimum of turbulence or splashing, both at the coating station and in the subsequent draining section. The lake 56 has a cut-away portion at the corner farthest from the coating station. This cut-away portion is provided with a weir 58 (which is shown more clearly in FIG. 24). The weir drains through a tun dish 60 into a bulk weighing tank 62, which will be described more fully with reference to FIGS. 23 and 25. The main supply of liquid coating material, held in a header tank 64 (FIGS. 1 and 2), passes via a normally-closed stop valve 66, FIG. 1, via a feed pipe 68 into the lake 56 when the valve 66 is open: thence it passes over the weir 58 into the bulk weighing tank 62. The lake 56 has a drain 70 with a normally-closed dump valve 72, to drain into the lower tray 54 when necessary.

Reference is now made to FIGS. 10 and 12, which show the coating station in detail. The chain runway mentioned above, fixed to the beam 50, is indicated at 74 above the chain 14, which is carried by the runway via a series of chain hangers 76 each freely movable along the runway by means of rollers 78. The chain hangers 76 are equally spaced along the chain. Attached to the opposite, i.e. lower, side of the chain below each of the chain hangers, there is a pivot bracket 80, to which a holder bracket 82 is pivoted on a horizontal axis. One of the holders 52 is itself secured to each of the brackets 82.

Each bracket 82 has an extension 84 carrying a freely-rotatable follower roller 86. At the coating station, as seen in FIG. 10, the roller 86 engages a rail 88 (the coating control rail), which is fixed to the main frame as diagrammatically indicated at 100 in FIG. 3. Roller 86 engages rail 88 by gravity, because the axis 90 of the holder 52 and of the container 2 carried by the latter is tilted as shown, by an angle of less than 90° to the vertical centre plane 102 of the chain 14. In this attitude, an O-ring 92, which is part of the holder 52, is frictionally engaged by a traction bar 94, extending through the coating station as seen in FIG. 12. The traction bar 94 is mounted by brackets 96 to the beam 50, but is carried by the brackets 96 via springs 98 which bias the bar 94 toward the holder 52.

A rigid mounting bracket 104 is secured to the main frame 100 and extends downwardly. At its lower end the bracket 104 has secured to it the rear end of a stainless steel curtain plate 106, which extends toward the centre plane 102 of the carrier chain and is curved downwardly to a terminal edge 108, which is bevelled to a fine edge. As can be seen from FIG. 10, the edge 108 of the curtain plate is very close to a point on the outer surface of a container 2 passing through the coating station 30, in or just below the neck 4 of the container. Preferably the lateral position of the curtain plate is adjustable, for example by means of its mounting screws 110. The vertical position of the curtain plate may also be made adjustable, by any suitable means (not shown).

The bracket 104 also carries an adjustable tube clamp 112 which holds a nozzle 114. This is the nozzle that delivers the coating material to the containers. It is connected to the bulk weighing tank 62 via a feed pipe 116 shown diagrammatically in FIGS. 3 and 4, the coating material being delivered to the nozzle by a feed pump 118 and variable control valve 126. The latter are shown diagrammatically in FIGS. 4 and 25: it will be understood that the positions in which they are shown mounted are not definitive but that the pump 118 and control valve 126 may be in any convenient locations.

The nozzle 114 may have a baffle plate 120 just behind its mouth. The nozzle mouth is arranged (by suitable adjustment of the tube clamp 112) preferably to be in actual contact with the rear surface 124 of the curtain plate, as seen at 122, but not of course over the whole periphery of the nozzle mouth. A gap 128 must be left for the coating material to escape from the nozzle. If however the point of contact 122 of the nozzle mouth with the curtain plate is at the top of the former as shown, the material will emerge downwards and sideways, impinging on the reare surface of the curtain plate and spreading out over the latter. It then runs down the plate, so as to leave it in the form of a curtain of liquid depending from the lower edge 108 of the plate 106. Such a curtain can be seen at 130 in FIGS. 10 and 12. The characteristics of the curtain 130, such as width, thickness, parallelism and so on, are determined by suitable adjustment of the flow velocity by means of the main flow control valve 126.

Reverting to FIG. 3, there is shown a sensing rail 132 preceding the coating control rail 88 in the direction of motion of the chain 14. The sensing rail 132 is shown more clearly in FIG. 5. It is fixed to the main frame of the machine. Its purpose is to cause the containers 2 to tilt into the attitude shown in FIG. 10. The rail 132 has a lead-in portion 134 parallel to the centre plane 102 of the chain, leading via a diverting portion 136 to a second parallel portion 140. The latter leads via a further portion 142 of the rail to a transfer portion 144, again parallel to the plane 102. The transfer portion overlaps a short part of the coating control rail 88.

In FIGS. 6 to 8, the action of the sensing rail 132 is illustrated. FIG. 6 shows a container 2 at the point where it makes its initial contact with the diverting portion 136, which tilts the container outwardly to the attitude seen in FIG. 7, in which it is supported by the middle portion 140 of the rail 132. As the container then rides along the converging portion 142, its angle of tilt is reduced to that shown in FIG. 8, so that when it leaves the downstream end of the transfer portion 144, the roller 86 smoothly becomes fully supported by the coating control rail 88. If, however, the holder 52 is empty of a container as shown in FIG. 9, it misses the sensing rail and remains with its axis vertical throughout its passage through the coating station. In this way the holder 52 is kept away from an splashing of liquid coating material.

The construction of one of the holders 52 is shown in FIGS. 13 and 14. Basically it is of extremely simple design, comprising only two structural components, namely a body 146 and a plunger 148. The body is of "mushroom" form comprising a flat disc-like base 150 having a series of downwardly-depending, integral lugs or claws 152. Each claw 152 is of triangular section (see FIG. 14) and has an outwardly-facing profile fitting behind the neck 4 of a container 2. The body 146 is made of a resilient plastics material such as a structural polyamide (Nylon), and has a hollow stem 154 with a circumferential groove which hold the O-ring 92 previously mentioned. The stem 154 is secured rotatably in a hole in the holder bracket 82 by a circular spring clip 156. The plunger 148 is also of mushroom form, but is of metal such as steel, It comprises a simple disc-like head 158 having triangular notches to accommodate the claws 152. The head 158 is of approximately the same diameter as the body base 150, and has an integral stem 160, slidable freely up an down the bore of the body stem 154 and having its top end exposed for engagement with a knock-out ramp 162 shown in FIG. 18.

Referring to FIG. 18, the ramp 162 is fixed via brackets 164 to the beam 50 at the unloading station 40 (FIG. 2) of the machine. As each of the holders 52 carrying a container 2 reaches the ramp 162, and passes below it, the ramp forces the plunger stem 160 of the holder downwards so that the plunger 148 forces the container out of the holder.

The bulk weighing tank 62, as shown in FIGS. 23 and 25, is part of an automatic batch weighing system which ensures that there is a continuous supply of liquid coating material to be pumped to the coating station 30. The bulk tank 62 is mounted on a tilt plate 166 having a projecting portion 168 at one end, on which in this example the pump 118 is shown mounted. The tilt plate 166 is mounted at one side on a pair of heavy pivots 170. On the other side, the tilt plate projects beyond the bulk tank as shown at 172, this projecting portion being resiliently supported as for example by a set of compression springs 174. The springs 174 and the pivot blocks 170 are fixed on blocks 176 which lie in the lower drip tray 54 and are secured to the mainframe 100 of the machine.

As already described, the bulk tank 62 is supplied with liquid coating material from the weir 58 of the lake 56, via tun dish 60. Then the level of liquid in the tank 62 falls below a predetermined minimum, the weight of the tank becomes insufficient to keep the spring 174 compressed, so that the tilt plate 166 rises and operates suitable electrical switching means (not shown), to activate an alarm indicating a need for recharging the tank 62. This is done by opening the valve 66, FIG. 1. The switching means may alternatively be arranged to actuate means for automatically opening the valve 66, suitable means being provided to ensure that it is re-closed when the level of liquid in the tank 62 reaches a predetermined maximum permitted value, and that attention is drawin to the need for recharging the header tank 64, FIG. 1.

In operation, with the carrier chain in continuous forward movement and a continuous, controlled flow of liquid coating material at the coating nozzle 114, the containers pass in succession through the curtain of coating material 130 as seen in FIG. 10. The fine edge 108 of the curtain plate and its proximity to the surface of the container, with correct adjustment of the liquid flow to give even distribution of liquid across the curtain, enable the coating to be applied up to a precisely-defined height (indicated at 178 in FIG. 10). The container is rotated at least twice, and preferably three times, by engagement of the traction bar with the O-ring 92 while the container is in contact with the curtain 130.

The arrangement shown in FIG. 11 differs from that of FIG. 10 in having the coating control rail, here indicated by the reference numeral 180, on the same side of the holder bracket, 82, as the traction bar. The latter, indicated at 184, is carried, with the rail 180, by the same mounting brackets 184 secured to the beam 50. The roller 86 is carried on a short trunnion projecting from the bracket 82.

When the curtain 130 of liquid coating material is formed, there can tend to be surplus liquid at the outside edges of the curtain. This may cause or be associated with turbulence in the liquid. Turbulence must be avoided if the correct evenness of coating and precise location of the upper level (178, FIG. 10) of the coating are to be achieved, i.e. surging of liquid coming into contact with the container surface is to be avoided.

The modified curtain plate 186 shown in FIGS. 19 and 20 overcomes this problem if it occurs. The plate 186 has its ends cut away at an angle to the horizontal as shown, and this tends to spread the liquid at the outer edges of the curtain over the inclined parts 188 of the bottom edge 190.

Referring now to FIGS. 15 to 17 and FIG. 21, these show modifications for the coating of a container such as a PET bottle 191, FIG. 21, having a narrow neck. FIG. 17 shows another article having a narrow neck. In FIG. 21, the curtain plate 106 is the same as in FIG. 10 for a wide-mouthed container, but the bottle in this example is not tilted, hanging vertically instead as it passes through the coating station. Under these circumstances, provision of a sensing rail, coating control rail and a follower roller such as the rollers 86, is unnecessary. The holder 192, for a narrow-mouthed container comprises a simple combination of a generally-cylindrical body 194 of the same or similar resilient material as the holder body 146 in FIG. 10, and a mushroom-type plunger 200. The body 194 has integral, downwardly-depending resilient clases 196 which grip the container neck, 198, externally. The plunger 200 has a head 202 in the form of a simple disc of smaller diameter than the internal diameter of the claws 196, but functioning in exactly the same way as already described for the plunger 148 of FIG. 10.

Because the holder 192 is not required to tilt, the traction bar 94 is here mounted for resilient movement horizontally to engage the O-ring 92, again mounted around the holder body, so as to rotate the holder and the container carried by it as the latter passes through the curtain of coating material. The holder 192 is secured by a spring clip 204 to a rigid bracket 206 which is rigidly carried by the carrier chain 14 as seen in FIG. 21.

In FIG. 21, the coating level, i.e. the upper edge of the coating, is shown at 208. If this level must be higher, it is possible to modify the shape of the curtain plate so that its lower edge can be located below the flange shown at 210 around the neck of the bottle. Such modifications can be made whenever it is inappropriate for the simple curved design of curtain plate 106 to be used, provided there are no sudden changes in profile such as to cause local turbulence in the liquid. It is also preferable that the lower edge of the curtain plate be directed downwardly.

In FIG. 22, by way of example, the coating level 212 is higher than the level 208 in FIG. 21, and the curtain plate, 214, has a modified profile which is S-shaped in cross-section, leading to a short downward section 216 which terminates in the bottom edge 218.

Referring now to FIGS. 26 and 27, although (as has been seen from FIG. 9) the holders 52 can be arranged so that they will only tilt towards the source of liquid coating material if loaded with a container, it may be desired to ensure that an empty holder is as far away as possible from the danger of contamination by the coating material. This can be achieved by the provision of an empty holder diverting rail 200, fixed to the main frame of the machine by suitable means and having a lead-in portion 222 which is so placed that its side 224 opposite to the vertical centre plane 102 of the carrier chain will be engaged by the follower roller 86 of an empty carrier 52, but not by that of a carrier bearing a container. The lead-in portion 222 is therefore placed parallel with the central parallel portion 140 of the sensing rail. The diverting rail 220 is shaped as seen in FIGS. 26 and 27, so that it causes the empty holder 52 to swing away from the curtain plate 106.

There may be more than one coating station, using the plate curtain method described herein, suitably arranged to apply an appropriate number of coatings to the containers.

The technique of tilting the containers by means of the sensing rail, i.e. in response to the presence of the container, may be employed in coating machines in which the liquid coating material is applied by spraying or other known means instead of by the "curtain" method described above. Tilting assists the draining of excess material from some shapes of container; it also facilitates the application of a coating, for example by a localised spray head, to the underside of a container is such is required. This is particularly useful if the container has a re-entrant base. Again, if the container is of non-round cross-section, such as oval, the use of tilting makes easier the application of the coating by methods other than the "curtain" technique, as well as when this technique is itself chosen.

Referring now to FIG. 28, this shows another type of holder, 300, for internally gripping a hollow container 302 or other hollow article. The container 302 here shown is a plastics vessel having a cylindrical sidewall 304 without any shoulder or flange to be engaged supportably by the holder. The holder 300 can be mounted in a bracket 82 suspended from the chain conveyor in the manner already described; only the bottom plate of the bracket is shown in FIG. 28. The holder has a carrying head 304 comprising a mushroom-type member 306, with a generally cylindrical base 308 and an upstanding stem 310 carrying an O-ring 312 serving the same purpose as the ring 92 in FIG. 10 or 11; a clamping plate 314 coaxial with the base 308; and a peripheral, soft rubber grip ring 316 sandwiched between the base 308 and plate 314. The stem 310 has a central bore containing a rod 318 which carries a nut 320 bearing on the plate 314. The rod is biassed upwards by disc springs 322 bearing through a bush 324 on the top of the stem 310, so as to compress the grip ring 316. The bore of the ring 316 is restrained by a shoulder of the base 308, so that when thus compressed it presses radially against the vessel sidewall 304 to hold the vessel 302 frictionally with sufficient force to prevent it from becoming dislodged during its travel through the coating machine. This force can be adjusted by means of the nut 320, which is secured by a locknut.

When the holder 300 reaches the cam plate 162 (FIG. 18) the cam plate forces the rod 318 to relieve the grip ring and allow the vessel 302 to fall. A similar cam plate (not shown) is provided at the loading unit 22 to depress the rod 318 when the holder is introduced to the vessel 302.

Another holder is shown in FIGS. 29 to 31, at 330. The holder 330 has a cylindrical body 332, rotatable freely in a cylindrical member 333 332, rotatable freely in a cylindrical member 333 fixed to the bracket 82 and having a hollow bore through which a plunger 334 slidably extends. The plunger is biassed upwards by disc springs 335 and has a circumferential rebate 336 to engage a springloaded ball 338 which normally holds the plunger in the upper position shown in FIG. 30. Below the body 332, the plunger 334 carries a circular stop plate 340, having a terminal, annular lower stop surface 342 to engage the top end of the container 2; and a clamping block 334 having a frusto-conical peripheral upper surface 346. The block 344 and plate 340 are clamped together on the plunger 334, to move up and down with the latter. Within an annular recess in the stop plate 340, a ring 348 is axially slidable. The ring 348 is secured, through a hole in the plate 340, to the body 332, and carries a peripheral rubber sleeve 350.

In the upper position of the plunger 334, the clamping surface 346 forces the rubber sleeve against the inside surface of the container 2, to trap the end flange of the latter against the stop surface 342. When the plunger is forced downwardly (e.g. by the cam plate 162), the sleeve 350 is released as in FIG. 31.

FIG. 29 shows the stop plate 340 with a peripheral knurled surface to engage the rotation guide 94 in generally the same manner as the rubber O-ring 92 in FIG. 10, to rotate the holder 330.

Referring now to FIGS. 32 to 36, yet another holder 360, is again suspended from the chain 14 by a bracket 82 (pivoted as before to a bracket 80 secured to the chain). The holder 360 comprises a core block 362 fixed to the bracket 82 and surrounded by a holder body 364 which is free to rotate on the core block. The body 364 has three equi-spaced radial recesses 366 each accommodating a sprag 368 having a slot 370 to engage the end flange of a container 2. Each sprag 368 is held in its recess 366 by a common top plate 372 and a circumferential, resilient O-ring 374 which rests in a circumferential groove in the body 364. The slot 370 of each sprag is central on a camming portion 376 of the spray. A generally cylindrical internal chuck member 378, having a radial top flange 380, is carried below the holder body 364 by a central rod 382, biassed upwardly by a compression spring 384 to the normal position seen in FIG. 32.

In operation, the container 2 is engaged with the holder 360 at the transfer turret 46, FIG. 2, by being pushed upwardly so that the container end flange forces the sprags outwardly as shown in FIG. 33, against the inward radial force exerted locally by the O-ring 374. When the flange engages in the slot 370, the sprags return to their normal position, FIG. 34, and remain there until the camming plate 162, FIG. 18 forces the rod 382 downwardly. This cause the flange 380 of the chuck member to engage the camming portions 376 of the sprags to re-open them (FIG. 35) and so release the container 2. As seen in FIG. 36, the O-ring 374 may conveniently be used to engage the rotation drive rail 94 to rotate the holder and the container 2 at the coating station.

In the holder shown in FIG. 37, a cylindrical holder body 390 has a stem 392 which may be rotatably mounted in a bracket 82 (not shown) for rotation, and tilting if required, in the same manner as the holder shown in FIG. 13. Alternatively, rotation can be effected using an O-ring 394 around the body 390 itself. A carrier pad 396, profiled to engage the end flange of the container 2 as indicated in phantom lines, is carried below the body 390 by a rod 398 which can be spring-biassed upwards in the same manner as the rod 382 in FIG. 32, for example, Three spring steel pawls 400 are spaced equally around the inside of a skirt portion 402 of the body 390 to engage below the container flange and hold it against the pad 396. The container 2 is engaged with the holder by being pushed up so that the container flange becomes supported by dimples 404 of the pawls 398, and is released when the camming plate 162, FIG. 18, forces the rod 398 and pad 396 down so that a peripheral camming portion 406 of the pad engages an upper portion 408 of the pawls to open them and allow the container flange to fall past the dimples 404.

Referring now to FIG. 38, the chain 14 carries a bracket 420 in which a pivot pin 422, extending parallel to the path of the chain 14, is secured. A holder assembly 424 for a container 2 is suspended from the pin 422 so as to be tiltable laterally. The holder 424 comprises a central axle 426 and the parts carried directly or indirectly by the axle 426.

This central axle is generally cylindrical. The top end of the axle has a pivot head 428 carried by the pin 422, and a flange 430 against which the top end of a chuck 432 bears through a top bearing bush 434. The chuck 432 has a hollow cylindrical stem 435 extending upwardly from an intergral bottom chuck body 436, and is rotatable freely on the axle 426, on which it is mounted through the bush 434 and a bottom bearing bush 438.

The chuck stem 432 has axial splines 440, upon which are carried, reading downwards in FIG. 38, an upper guide roll 442, a radial bearing 444, a thrust washer 446, and a pressure plate 448. A release roll 450 having an enlarged bore engages on the underside of the thrust washer 446, and is supported on the pressure plate 448 by three equally-spaced balls 452, normally engaged in conical seatings in the release roll 450 and pressure plate 448. A reaction roll 454 is freely rotatable on the radial bearing 444. The upper surface of the chuck body 436, seen at 456, is surmounted by a coaxial, annular lower roll 458, secured to the chuck body by means not shown, so that the lower roll and the chuck 432 form a single unit, in which a number of radial recesses 460 are formed. In each recess 460 a bell crank 462 is pivoted, as at 464, in a split bearing 466 comprising bearing halves formed in the lower roll 458 and chuck body 436 respectively. In the right-hand one of the two recesses 460 visible in FIG. 38, the bell crank has been omitted for clarity.

Each bell crank 462 has a lower radial claw 468 to engage below the end flange of a container 2, and a radial arm 470 upon which there rests a spigot 472 of the pressure plate 448. The radial arm 470 is itself normally biassed upwardly by a compression spring 474 carried on a post integral with the chuck body 436. This hold the bell cranks in their normal or container-engaging position shown in the Figure, and also holds the pressure plate 448, through the balls 452, against the release roll 450. Suitable means, not shown, are provided for retaining the release roll, the bearing 444 and the upper guide roll 442, located in their axial positions with the roll 442 bearing, rotatably through a top thrust pad 476, against an upper ring 478 fixed to the axle 426.

During movement of the holder 424, carrying a container 2, through the coating machine, it is maintained in the required lateral orientation (vertical as shown, or tilted) by three-point lateral support provided partly by a groove guide rail 480 against which the upper guide roll 442 is freely rotatable, and partly by the drive rail 94 (for example as previously described), which engages the outside of the lower roll to rotate the lower roll, chuck 432 and container 2. The lower roll, the chuck, and the other parts of the holder assembly rotatable with them, constitute the holder for an article such as the container 2. The third element providing three-point lateral support is a reaction rail 482 which is engaged by the reaction roll 454 to provide mechanical reaction against the driving force between the drive rail 94, and lower roll 458. At the unloading station 40 (FIG. 2), there is a fixed release rail 484, which has a camming action to force the release roll 450 laterally sideways, thus driving the balls 452 downwards to open the bell cranks 462 through the pressure plate 448. A similar rail is provided at the loading station 22, FIG. 2, this time to restore the release roll to its coaxial position when a container 2 has been introduced against the chuck body 436.

Reference is now made to FIGS. 39 to 44, which illustrate a coating machine generally similar to that already described except that it is adapted by the addition of an auxiliary coating station for applying a coating to that part of the recipient surface of the articles which is not coated by application of the coating material at the ccating station 30, which in the context of FIGS. 39 to 44 will be called the main coating station.

Referring to FIGS. 39 and 40, the auxiliary coating station is indicated at 500, upstream of the section 26 of the machine, which is now not strictly a "dry" section since containers wet with some coating material will pass through it. The main drain tray (or lake, or pan) 56 is extended so as to lie under the whole of the auxiliary coating station 500 and the section 26. The station 500 has a supply nozzle 512 for supplying the coating material for use at that station. The nozzle 512 is itself supplied, for example through a branch pipe 513, from the same feed pipe 116 as is the nozzle or jet at the main coating station 30. Thus both stations share a common coating material supply system and a common draining and recirculating system for excess coating material, which is allowed to fall freely and without obstruction from the auxiliary coating station into the lake 56 (see 578 in FIG. 44).

In FIGS. 42 to 44, the articles being coated are shown, purely by way of non-limiting example, as being the same containers 302 as shown in FIG. 28, the holders illustrated in FIGS. 42 to 45 all being, again by way of non-limiting example, the holders 300 of FIG. 28. At the auxiliary coating station, a band of coating material is applied around the axi-symmetrical, endless upper portion 580 of the outer or recipient surface of the sidewall 304 of each container 302.

At the coating station 500, a mounting plate 508 secured to the machine main frame 100, carries two bearing blocks 540, 542 in which a pair of pulley shafts 544, 546 respectively are fully rotatable on vertical axes. The lower end of the shaft 544 carries a belt pulley 505, and that of the shaft 546 a belt pulley 506. The upper end of the shaft 544 carries a pulley 510 which is driven through a drive belt 511 by another pulley, coupled to a donor belt drive motor 509.

A donor belt 504 extends around the belt pulleys 505 and 506, and has a straight working or coating course 548 parallel to the chain 14 and running so as to be engaged by the containers 302. The opposite course of the belt 504, indicated at 550, has a nozzle or jet 512 arranged to direct a stream of liquid coating material (supplied from a source not shown) against the outer or donor surface 552 of the belt 504.

The donor belt 504 has to be kept under suitable tension, to which end any convenient tensioning device may be used. That shown in FIGS. 42 and 43 comprises a pair of compression springs 554 bearing at one end on a thrust block 556 mounted on the plate 508. The other ends of the springs 554 engage the bearing block 542, which is mounted in an elongated hole 558 in the plate 508 so that its axis is laterally translatable under the control of the springs 554.

A back support device 560 may be provided behind the working course 548 of the belt, to provide a positive, controlled lateral reaction force for engagement of the belt 504 with the containers 302. In this example, the device 560 comprises a frame 562, carrying a set of free-running rollers 564 and urged toward the belt 504 by resilient elements indicated diagrammatically at 566, which may be mechanical springs or fluid-pressure devices that may be made controllable so as to vary the pressure applied and thus the force exerted by the device 560.

The donor belt 504 may take any convenient form. It should be strong enough to withstand normal forces met in use, and to this end it may be of laminated construction with a resilient outer layer mounted on a stout backing layer, which is impervious to penetration by the coating material and is typically of a drive belt material. The outer layer, or the belt itself if unlaminated, is resilient enough to conform, as shown at 574 in FIG. 45, to significant changes in contour of the article 516, being coated. Whether or not the belt is of laminated construction, the donor surface 552, on the outer side of the drive belt, is of a texture capable of holding an even film of the coating material, but the material of which it is made should not be absorbent of the coating material (otherwise the latter, on drying, will clog and stiffen the belt).

In operation, as the chain 14 is moved forward at constant speed to convey the containers 302, they are brought into contact with the donor surface which is being driven at constant speed along a parallel path as indicated by the arrow W in FIG. 42. The containers 302 are kept in continuous rotation by engagement of the O-rings 312 of the holders 300 with a rotation drive rail 538 is shown resiliently mounted in the same way as the rail 94 in FIG. 10. The nozzle 512 directs a continuous stream of liquid coating material 576 onto the back course of the belt 504, excess coating material falling freely to the lake as already mentioned.

The belt 504 transfers a band of coating material to the upper portion 580, the lower edge 581 of which, and hence the band width, is determined by the width of the belt 504 and the location of the upper edge of the container 302 across the width of the belt. The line 581 is preferably just below the upper limit of the area to which coating is then applied at the main coating station 30.

The donor surface 552 will accept an amount of coating material over a given area of the surface up to the maximum which it is capable of retaining. The weight of coating material transferred to a bottle can be predetermined by, for example, providing an adjustable doctor blade 582, FIG. 42, in association with the belt 504.

In FIGS. 41 and 45, the axes 591 of the belt pulleys 505, 506 are inclined to the vertical. This may be adopted with or without tilting of the article being coated. FIG. 45 shows a container 516 tilted with its axis 518 non-parallel to the axes 591, because of the requirements of the profile of the upper portion 520 of this particular container. The axes may all be inclined at the same angle to the vertical. The belt in FIG. 45 applies a band of coating to the portion 520 having the same width as the belt and extending downwardly from the extreme upper end of the outer surface of the container.

The container 516 is tilted prior to being brought into contact with the belt 504, by means of a fixed tilt bar 522, FIG. 41, generally similar to the tilt bar (sensing rail 132) already described in detail with reference to FIGS. 3 to 5. A coating control rail 524, general similar to the rail 88 of FIG. 3 and others of the Figures, maintains the inclined attitude of the container through the auxiliary coating station. If a different angle of tilt is not required at the main coating station, the rail 524 can extend through the latter in place of the rail 88. If a different angle of tilt is required, a transfer rail 526 to effect the change of angle can be provided between the two coating control rails 524, 88.

We claim:

1. A method of applying a coating over a non-horizontal recipient surface of an article, comprising the steps of:

directing a supply of liquid coating material against a back surface of a curtain plate so as to spread the liquid over the back surface to fall as a curtain from a lower edge of the curtain plate;

effecting continuous relative movement as between the article and the curtain plate, with the article closely in front of the curtain plate, such that the recipient surface intersects the curtain;

allowing the material to run freely down the recipient surface and allowing excess material to drain freely from it; and causing the coating so applied to dry on the recipient surface.

2. A method according to claim 1, for coating an external recipient surface which extends around the article, wherein the step of effecting relative movement comprises simultaneously causing the recipient surface to intersect the curtain and effecting relative rotation as between the curtain plate and the article, so as to present the recipient surface progressively to the curtain.

3. A method according to claim 1, for coating an external recipient surface endless in cross-section and defining an axis of the article, wherein the step of effecting relative movement comprises simultaneously advancing the article along a path generally parallel to the lower edge of the curtain plate to cause the recipient surface to intersect the curtain, and rotating the article about its own axis, the curtain plate being maintained stationary.

4. A method according to any one of the preceding claims for coating an article in the form of a hollow vessel, comprising the preliminary step of engaging the vessel from above with a holder, the step of effectng relative movement being carried out with every part of the holder exposed outside the vessel being maintained above the level of the upper edge of the coating material vertically below it on the recipient surface.

5. A method according to claim 3, wherein the step in which the recipient surface intersects the curtain is carried out with the central axis inclined to the vertical.

6. A method according to claim 5 in which the axis of the article is initially substantially vertical, the method comprising the further step of engaging the recipient surface itself with a tilting member to tilt the article to its inclined attitude before introducing the recipient surface and the curtain to each other, and maintaining the inclination of the central axis with respect to the curtain until the article has left the curtain.

7. A method according to claim 5, in which the article is advanced towards the curtain plate with its axis substantially vertical, the method comprising the further steps of engaging the recipient surface itself with a stationary tilting member prior to the article reaching the curtain, so as to tilt the article to its inclined attitude, and maintaining the inclination of the central axis with respect to the curtain until the article has left the curtain.

8. A method according to claim 1 or claim 3 or claim 7, wherein the step of effecting relative movement as between the article and the curtain plate is carried out with an upper portion of at least that part of the recipient surface facing the curtain plate located above the level of the lower edge of the curtain plate so that the upper portion does not intersect the curtain.

9. A method according to claim 8, including the further step of applying a band of coating material over the upper portion of the recipient surface before or after applying a coating by means of the curtain.

10. A method according to claim 9, wherein the step of coating the upper portion comprises:

directing a stream of liquid coating material on to a moving donor surface of an elongate donor member while moving the latter continuously along a first path, so as to charge the donor surface with a predetermined quantity of the material; and effecting continuous relative movement as between the recipient surface and the donor surface so that the latter transfers coating material on to the upper portion of the former in said band.

11. A method according to claim 10, including the further step, prior to bringing the recipient surface into contact with the donor surface, of tilting the article so as to orientate the recipient surface to engage the donor surface in a line of contact over the whole width of the band.

12. A method according to claim 10, in which said donor member is in the form of an endless belt, the method comprising maintaining, while the belt is in contact with the article, both the article in its rotation and the belt in motion in said first path.

13. Apparatus for applying a coating over a recipient surface of an article, comprising:

holding means for holding the article with the recipient surface in a non-horizontal attitude;

a forwardly and downwardly curved curtain plate having a generally horizontal, free lower edge;

nozzle means for directing a continuous supply of liquid coating material against the back surface of the curtain plate so as to spread the liquid over the back surface to fall as a curtain from its lower edge;

means for effecting continuous relative movement as between the article and the curtain plate such that, with the holding means and the article closely in front of the curtain plate, the recipient surface will intersect the curtain when the nozzle means is operating; and drying means for drying coating material applied to the article by its contact with the curtain.

14. Apparatus according to claim 13, for coating an external recipient surface endless in cross section and defining an axis of the article, wherein the apparatus includes rotating means for effecting relative rotation as between the curtain plate and the article, so that the recipient surface is presented progressively to the curtain during such relative rotation.

15. Apparatus according to claim 14, wherein the curtain plate is stationary, the apparatus including artcle-advancing means for moving the article along a forward path past the curtain plate and generally parallel to the lower edge of the curtain plate (whereby to effect said relative movement), the rotating means comprising a rotatable element of the holding means, to be coaxial with the article when an article is being held, and a cooperating driving element for rotating the rotatable element about its axis throughout the advance of the article past the curtain plate.

16. Apparatus according to claim 13, wherein the driving element for co-operation with the rotatable element of the holding means comprises a drive rail extending past, and generally in front of, the curtain plate, the drive rail being generally parallel to the forward path.

17. Apparatus according to claim 16, wherein the drive rail is mounted in a fixed position save that it is biassed by resilient means towards the path of the holding means so as to exert positive pressure on the rotatable element of the latter.

18. Apparatus according to claim 16 including a tilting member associated with the forward path upstream of the curtain plate, to engage the recipient surface itself whereby to tilt the article and holding means into an inclined attitude with the axis of the article inclined to the vertical, and a tilt guide member for cooperating with the holding means for maintaining the inclined attitude throughout the advance of the article past the curtain plate, the holding means having a guide follower means for co-operating with the guide member, and wherein the drive rail is so disposed as to engage the rotatable element of the holding means when the holding means is in its said inclined attitude.

19. Apparatus according to claim 15, including a tilting member associated with the forward path upstream of the curtain plate, to engage the recipient surface itself whereby to tilt the article and holding means into an inclined attitude with the axis of the article inclined to the vertical, and a tilt guide member for co-operating with the holding means for maintaining the inclined attitude throughout the advance of the article past the curtain plate, the holding means having a guide follower means for co-operating with the guide member.

20. Apparatus according to claim 19, wherein the tilting member is a simple, fixed bar appropriately shaped to effect tilting and to cause the holder to engage the guide member.

21. Apparatus according to claim 19, wherein the tilt guide member is a fixed rail extending parallel to the forward path.

22. Apparatus according to claim 19, wherein the tilt guide member and guide follower means are so disposed as to come into co-operation with each other only if an article held by the holding means has been tilted by the tilting member, so that the holding means fails to assume the said inclined attitude unless holding a said article.

23. Apparatus according to claim 22, including further guide means for engaging guide follower means on the holding means so as to deflect the latter away from the curtain plate, the further guide means being downstream of the tilting member with respect to the forward path and so disposed that it can only engage its associated guide follower means if the holding means has failed to be tilted by engagement of an article held thereby with the tilting member, the further guide means being arranged to keep the holding means so tilted away until it has passed the curtain plate.

24. Apparatus according to claim 23, wherein the said further guide member is a fixed rail extending parallel to the forward path.

25. Apparatus according to claim 23, wherein a single guide follower means is provided on the holding means for engagement with either one of the guide members.

26. Apparatus according to claim 13, wherein the lower edge of the curtain plate is relieved in end portions thereof and horizontal between the end portions.

27. Apparatus according to claim 13, wherein the lower edge of the curtain plate is formed on a downward lip joined by a forwardly extending flange portion to a main, forwardly and downwardly curved portion of the plate.

28. Apparatus according to claim 13, wherein the holding means comprises a holder having a carrying head with integral resilient fingers depending therefrom, the fingers being so arranged that when resiliently deformed they define together an endless profile corresponding to the profile of a portion of an article to be gripped by the fingers and a plunger member mounted freely in the carrying head and reciprocable downwardly to eject the article from the holder, the apparatus including a plunger-engaging member for forcing the plunger downwardly, downstream of the drying means.

29. Apparatus according to claim 28, wherein the carrying head has an upwardly-extending stem carrying a coaxial friction ring which constitutes the rotatable element for rotating the holder.

30. Apparatus according to claim 28 or claim 29, wherein the resilient fingers are arranged in a circle so that said profile is circular.

31. Apparatus according to claim 13, wherein the holding means are adapted to present to the curtain an article, the recipient surface of which is endless in cross section and defines an axis of the article, in an inclined attitude to the vertical.

32. Apparatus according to claim 13, having a main coating station at which the curtain plate is located, an auxiliary coating station having band coating means for applying a band of coating material over an upper portion of the recipient surface not coated at the main coating station, and transfer means for moving holding means carrying the article between the two stations.

33. Apparatus according to claim 32, for coating an article of which the recipient surface, including said upper portion, is external and extends axi-symmetrically around the article to define a central axis of the article, wherein the band coating means comprises:

an elongate donor member having a donor surface defining the band width for transferring liquid coating material to the recipient surface;

nozzle means for directing a continuous supply of said material against a portion of the donor surface;

donor drive means for continuously moving the donor member to transfer the coating material applied by the nozzle means to a position for transferring the material to the article; and rotating means for effecting relative rotation as between the donor surface and the article, so as to present the upper portion of the recipient surface progressively to the donor surface during such rotation.

34. Apparatus according to claim 33, wherein the donor member is sufficiently resilient to conform with changes in contour in the area of said band on the recipient surface, whereby to make contact with the said area over the whole band width.

35. Apparatus according to claim 33, wherein the holding means are adapted to present to the donor member an article, having its recipient surface extending externally and axisymmetrically around the article to define a central axis, in an inclined attitude with its central axis inclined to the vertical.

36. Apparatus according to claim 33, wherein the donor member is an endless belt, the band coating means further comprising at least two belt pulleys, the belt extending around the belt pulleys to define a substantially straight article-engaging course of the belt and a further belt course adjacent the nozzle for receiving coating material from the latter.

37. Apparatus according to claim 36, wherein one of the belt pulleys is coupled with the donor drive means, another being mounted with its axis translatable laterally under the control of resilient tensioning means whereby to induce sufficient tension in the article-engaging course of the belt.

38. Apparatus according to claim 33, wherein the curtain plate and the band coating means are in fixed locations, the apparatus including article-advancing means for moving the article along a forward path past the curtain plate and the band coating means (either before the other), the rotating means comprising a rotatable element of the holding means to be coaxial with the article when an article is being held, and a co-operating driving element for rotating the rotatable element about its axis throughout the advance of the article in contact with the donor member.

39. Apparatus according to claim 38, wherein the driving element for co-operation with the rotatable element of the holding means comprises a drive rail extending past the band coating means and parallel with the forward path.

40. Apparatus according to claim 33, wherein the belt pulleys are mounted with their axes inclined to the vertical, so that the article-engaging course of the belt is non-horizontal.

41. Apparatus according to claim 39, wherein the drive rail is mounted in a fixed position save that it is biassed by resilient means towards the holding means so as to exert positive pressure on the rotatable element of the latter.

42. Apparatus according to claim 38, wherein the driving element for co-operation with the rotatable element of the holding means comprises a drive rail extending past the band coating means and generally parallel to the forward path.

43. Apparatus according to claim 42, wherein the drive rail is mounted in a fixed position save that it is biassed by resilient means towards the path of the holding means so as to exert positive pressure on the rotatable element of the latter.

44. Apparatus according to claim 38, including a tilting member associated with the forward path upstream of the band coating means, to engage the recipient surface itself whereby to tilt the article and holding means into an inclined attitude with the central axis of the article inclined to the vertical, and a tilt guide member for maintaining the inclined attitude throughout the advance of the article in contact with the donor member.

45. Apparatus according to claim 44, wherein the holding means has a guide follower means for engaging the tilt guide member.

46. Apparatus according to claim 44, wherein the tilt guide member is so disposed as to be operative only if an article held by the holding means has been tilted by the tilting member, so that the holding means fails to assume the said inclined attitude unless holding a said article.

47. Apparatus according to any one of claims 44 to 46, wherein the tilting member is a simple, fixed bar appropriately shaped to effect tilting and to cause the holder to engage the guide member.

48. Apparatus according to any one of claims 44 to 47, wherein the tilt guide member is a fixed rail extending parallel to the forward path.

* * * * *

UNITED STATES PATENT AND TRADEMARK OFFICE

CERTIFICATE OF CORRECTION

PATENT NO. : 4,809,640

DATED : March 7, 1989

INVENTOR(S) : Terence W.J. Pilley, Fred R. Pilling, Graham Ryall

It is certified that error appears in the above-identified patent and that said Letters Patent is hereby corrected as shown below:

On the Front Page

Inventors, change "Fred B. Pilling" to -- Fred R. Pilling --.

In the Specification:

Column 1, line 41, before "curtain" insert -- a --.

Column 2, line 12, after "applications" delete the period.
Column 2, line 38, change "applyig" to -- applying --.
Column 2, line 48, change "effectng" to -- effecting --.

Column 3, line 12, change "beiing" to -- being --.

Column 4, line 11, change "Figurse" to -- Figures --.

Column 6, lines 50,51, change "FIG." to -- FIGS. --.
(both occurrences)

Column 8, line 11, change "reare" to -- rear --.
Column 8, line 47, change "an" to -- any --.
Column 8, line 60, change "hold" to -- holds --.
Column 8, line 64, after "steel" change the comma to a period.

Column 9, line 39, change "drawin" to -- drawn --.
Column 9, line 59, change "184" to -- 182 --.

Column 10, line 24, change "clases" to -- claws --.
Column 10, line 62, change "200" to -- 220 --.

Column 11, line 17, change "is" to -- if --.

Column 12, line 44, change "cause" to -- causes --.

UNITED STATES PATENT AND TRADEMARK OFFICE

CERTIFICATE OF CORRECTION

PATENT NO. : 4,809,640

DATED : March 7, 1989

INVENTOR(S) : Terence W.J. Pilley, Fred R. Pilling, Graham Ryall

It is certified that error appears in the above-identified patent and that said Letters Patent is hereby corrected as shown below:

Column 13, line 17, change "intergral" to -- integral --.
Column 13, line 45, change "hold" to -- holds --.
Column 13, line 58, change "groove" to -- grooved --.

Column 15, line 38, after "538" insert -- which can be generally similar to the rail 94 of Figure 10, for example. In Figure 44, the drive rail 538 --.

Column 16, line 5, change "general" to -- generally --.

<u>In the Claims</u>

Column 21, line 7, delete "simple,".

Signed and Sealed this

Tenth Day of October, 1989

*Attest:*

*Attesting Officer*

DONALD J. QUIGG

*Commissioner of Patents and Trademarks*